US011112733B2

(12) United States Patent
Sekiya et al.

(10) Patent No.: US 11,112,733 B2
(45) **Date of Patent: *Sep. 7, 2021**

(54) IMAGE FORMING APPARATUS AND PROCESS CARTRIDGE INCLUDING A TONER SATISFYING RELATIONS

(71) Applicant: FUJIFILM Business Innovation Corp., Tokyo (JP)

(72) Inventors: Jun Sekiya, Kanagawa (JP); Masataka Kuribayashi, Kanagawa (JP); Makoto Kamisaki, Kanagawa (JP); Shota Oshima, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/535,371

(22) Filed: Aug. 8, 2019

(65) Prior Publication Data

US 2020/0292969 A1 Sep. 17, 2020

(30) Foreign Application Priority Data

Mar. 13, 2019 (JP) ..... JP2019-046328

(51) Int. Cl.
*G03G 15/16* (2006.01)
*G03G 9/087* (2006.01)
*G03G 15/08* (2006.01)

(52) U.S. Cl.
CPC ..... *G03G 15/161* (2013.01); *G03G 9/08797* (2013.01); *G03G 15/0808* (2013.01); *G03G 15/168* (2013.01); *G03G 9/08755* (2013.01)

(58) Field of Classification Search
CPC ..... G03G 15/161; G03G 15/168; G03G 15/0808; G03G 9/0825; G03G 9/083; G03G 9/08755; G03G 9/08711; G03G 9/08782; G03G 15/0914; G03G 9/08797
See application file for complete search history.

(56) References Cited

U.S. PATENT DOCUMENTS

| | | | | |
|---|---|---|---|---|
| 6,040,104 | A | 3/2000 | Nakamura et al. | |
| 10,613,466 | B1 * | 4/2020 | Fukuda | G03G 21/105 |
| 10,656,558 | B1 * | 5/2020 | Morooka | G03G 15/0867 |
| 10,670,998 | B1 * | 6/2020 | Ota | G03G 9/08797 |
| 10,795,305 | B1 * | 10/2020 | Kuribayashi | G03G 21/0011 |
| 2007/0212631 | A1 * | 9/2007 | Abe | G03G 9/0806 430/109.3 |

(Continued)

FOREIGN PATENT DOCUMENTS

| | | | | |
|---|---|---|---|---|
| JP | 02161458 A | * | 6/1990 | G03G 9/09378 |
| JP | 06-011876 A | | 1/1994 | |
| JP | 11-194542 A | | 7/1999 | |

*Primary Examiner* — Walter L Lindsay, Jr.
*Assistant Examiner* — Laura Roth
(74) *Attorney, Agent, or Firm* — Sughrue Mion, PLLC

(57) ABSTRACT

An image forming apparatus includes: a developing section that forms a toner image by developing an electrostatic latent image using toner. The toner satisfies the following relations: $(\ln\eta(T1)-\ln\eta(T2))/(T1-T2)\leq-0.14$; $(\ln\eta(T2)-\ln\eta(T3))/(T2-T3)\geq-0.15$; and $(\ln\eta(T1)-\ln\eta(T2))/(T1-T2)<(\ln\eta(T2)-\ln\eta(T3))/(T2-T3)$, where $\eta(T1)$ represents a viscosity of the toner at 60° C., $\eta(T2)$ represents a viscosity of the toner at 90° C., and $\eta(T3)$ represents a viscosity of the toner at 130° C.).

14 Claims, 3 Drawing Sheets

(56) References Cited

U.S. PATENT DOCUMENTS

| | | | | |
|---|---|---|---|---|
| 2008/0176153 | A1* | 7/2008 | Jeong | G03G 9/0821 430/48 |
| 2009/0214965 | A1* | 8/2009 | Jeong | G03G 9/0821 430/48 |
| 2010/0129743 | A1* | 5/2010 | Zhang | G03G 5/144 430/57.1 |
| 2020/0292964 | A1* | 9/2020 | Kitajima | G03G 15/0891 |
| 2020/0292983 | A1* | 9/2020 | Oshima | G03G 21/0011 |
| 2020/0301311 | A1* | 9/2020 | Koide | G03G 9/0819 |
| 2020/0310307 | A1* | 10/2020 | Yawada | G03G 9/08711 |

* cited by examiner

IMAGE FORMING APPARATUS AND PROCESS CARTRIDGE INCLUDING A TONER SATISFYING RELATIONS

CROSS-REFERENCE TO RELATED APPLICATIONS

This application is based on and claims priority under 35 USC 119 from Japanese Patent Application No. 2019-046328 filed Mar. 13, 2019.

BACKGROUND

(i) Technical Field

The present disclosure relates to an image forming apparatus and a process cartridge.

(ii) Related Art

Electrophotographic image formation is performed by, for example, charging the surface of an electrophotographic photoreceptor, forming an electrostatic charge image on the charged surface of the electrophotographic photoreceptor in accordance with image information, developing the electrostatic charge image using a developer that includes toner for developing the electrostatic charge image to form a toner image for developing the electrostatic charge image, and transferring the toner image to the surface of a recording medium and fixing the toner image there.

Japanese Laid Open Patent Application Publication No. 11-194542 discloses an electrophotographic toner for developing an electrostatic charge image. The electrophotographic toner includes a binder resin and a coloring agent, and the binder resin has its minimum tan δ at a temperature between its glass transition temperature (Tg) and the temperature at which its loss modulus $(G')=1\times10^4$ Pa. The minimum tan δ is less than 1.2, and at the temperature at which the tan δ is at its minimum, the resin has a storage modulus $(G')=5\times10^5$ Pa or more. At the temperature at which $G'=1\times10^4$ Pa, the tan δ is 3.0 or more.

Japanese Laid Open Patent Application Publication No. 6-011876 discloses an electrophotographic photoreceptor. The electrophotographic photoreceptor has a photosensitive layer and a protective layer on a conductive support, and the protective layer is made using a coating liquid that is a dispersion of fine particles of a conductive metal oxide in a curable acrylic monomer having a particular structure. To form the protective layer, the coating liquid is applied to the photosensitive layer and cured.

A known type of image forming apparatus has an electrophotographic photoreceptor, a charging section, a section for forming an electrostatic charge image, a developing section, a transfer section, and a cleaning section. The developing section contains a developer for an electrostatic charge image and develops the electrostatic charge image formed on the surface of the electrophotographic photoreceptor into a toner image for developing an electrostatic charge image using the developer for an electrostatic charge image. The developer for an electrostatic charge image includes toner for developing an electrostatic charge image, and the toner contains toner particles. (This type of image forming apparatus may hereinafter be referred to as a "specific image forming apparatus.)

Specific image forming apparatuses of the related art can suffer streak-shaped image defects. One such defect is caused by the adhesion of crushed and spread toner particles to the surface of the electrophotographic photoreceptor at the point of contact between a cleaning blade and the electrophotographic photoreceptor (hereinafter also referred to as "filming"). A streak-shaped image defect also occurs when the cleaning blade fails to catch residual toner.

SUMMARY

Aspects of non-limiting embodiments of the present disclosure relate to an image forming apparatus that reduces both types of streak-shaped image defects, respectively caused by filming and passed toner residue, in comparison with specific image forming apparatuses in which the toner for developing an electrostatic charge image in the developer for an electrostatic charge image has a $(\ln\eta(T1)-\ln\eta(T2))/(T1-T2)$, described hereinafter, exceeding −0.14 or in which the toner in the developer has a $(\ln\eta(T2)-\ln\eta(T3))/(T2-T3)$, described hereinafter, of less than −0.15.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: an image carrier that includes a conductive substrate and also includes a photosensitive layer and a surface-protecting layer on the conductive substrate; a charging section that charges the surface of the image carrier; a latent-image-forming section that forms an electrostatic latent image on the image carrier; a developing section that forms a toner image by developing the electrostatic latent image using toner for electrostatic charge image development; a transfer section that transfers the toner image to a recording medium; and a cleaning section that removes toner residue on the surface of the image carrier using a cleaning blade. The toner satisfies the following relations: $(\ln\eta(T1)-\ln\eta(T2))/(T1-T2)\leq-0.14$; $(\ln\eta(T2)-\ln\eta(T3))/(T2-T3)\geq-0.15$; and $(\ln\eta(T1)-\ln\eta(T2))/(T1-T2)<(\ln\eta(T2)-\ln\eta(T3))/(T2-T3)$, where η(T1) represents a viscosity of the toner at 60° C., η(T2) represents a viscosity of the toner at 90° C., and η(T3) represents a viscosity of the toner at 130° C.

BRIEF DESCRIPTION OF THE DRAWING

An exemplary embodiment of the present disclosure will be described in detail based on the following figures, wherein.

DETAILED DESCRIPTION

Figure 1:
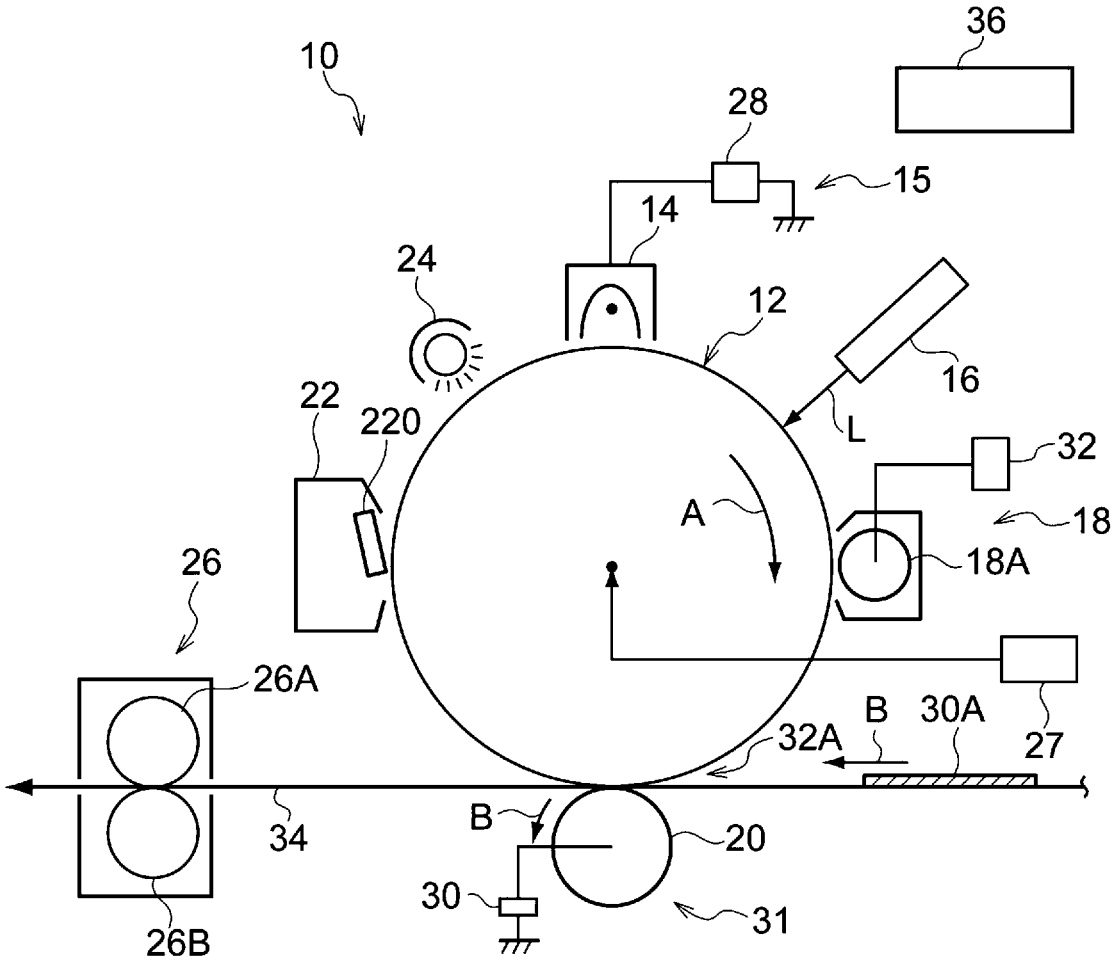
FIG. 1 schematically illustrates the structure of an example of an image forming apparatus according to this exemplary embodiment.

The following describes an exemplary embodiment of the present disclosure. The following description and Examples are intended to illustrate the exemplary embodiment and do not limit the scope of the exemplary embodiment.

The present disclosure mentions series of numerical ranges. The upper or lower limit of one of such numerical ranges may be substituted with the upper or lower limit of another numerical range in the same series. The upper or lower limit of a numerical range herein may be substituted with a value specified in Examples.

An ingredient herein may be a combination of multiple substances. If a composition described herein contains a combination of multiple substances as an ingredient, the amount of the ingredient represents the total amount of the substances in the composition unless stated otherwise.

Image Forming Apparatus

An image forming apparatus according to an exemplary embodiment includes an image carrier that includes a conductive substrate and also includes a photosensitive layer and a surface-protecting layer on the conductive substrate; a charging section that charges the surface of the image carrier; a latent-image-forming section that forms an electrostatic latent image on the image carrier; a developing section that forms a toner image by developing the electrostatic latent image using toner for electrostatic charge image development; a transfer section that transfers the toner image to a recording medium; and a cleaning section that removes toner residue on the surface of the image carrier using a cleaning blade. An image forming apparatus having this structure may hereinafter be referred to as a "specific image forming apparatus."

The image forming apparatus according to this exemplary embodiment, moreover, contains an electrostatic-charge-image developer that includes toner for electrostatic charge image development. The toner has the following characteristics: $(\ln\eta(T1)-\ln\eta(T2))/(T1-T2)\leq-0.14$; $(\ln\eta(T2)-\ln\eta(T3))/(T2-T3)\geq-0.15$; and $(\ln\eta(T1)-\ln\eta(T2))/(T1-T2)<(\ln\eta(T2)-\ln\eta(T3))/(T2-T3)$, where $\eta(T1)$ represents the viscosity of the toner at 60° C., $\eta(T2)$ represents the viscosity of the toner at 90° C., and $\eta(T3)$ represents the viscosity of the toner at 130° C. A toner according to this exemplary embodiment for electrostatic charge image development having these characteristics may hereinafter be referred to simply as a "specific toner."

The following describes the characteristics of a specific toner used in this exemplary embodiment.

The formula $(\ln\eta(T1)-\ln\eta(T2))/(T1-T2)$ is a measure of how much the viscosity of the toner changes at temperatures from 60° C. to 90° C., and a $(\ln\eta(T1)-\ln\eta(T2))/(T1-T2)$ of −0.14 or less means that the toner greatly changes its viscosity at temperatures from 60° C. to 90° C. The formula $(\ln\eta(T2)-\ln\eta(T3))/(T2-T3)$, on the other hand, is a measure of how much the viscosity of the toner changes at temperatures from 90° C. to 120° C., and a $(\ln\eta(T2)-\ln\eta(T3))/(T2-T3)$ of −0.15 or more and greater than the $(\ln\eta(T1)-\ln\eta(T2))/(T1-T2)$ means that the toner changes little its viscosity at temperatures from 90° C. to 120° C. The specific toner therefore changes its viscosity sharply at temperatures from 60° C. to 90° C. and little at temperatures from 90° C. to 120° C. In a toner that exhibits such a viscosity profile, the inventors believe, the binder resin contained in the toner particles has low molecular weight and high molecular weight components both in appropriate proportions. That is, a low molecular weight component in the binder resin promotes changes in viscosity at temperatures from 60° C. to 90° C., whereas a high molecular weight component in the binder resin limits changes in viscosity at high temperatures from 90° C. to 120° C.

Given such a viscosity profile, the specific toner changes little its viscosity and has moderate viscoelasticity at temperatures from room temperature (e.g., 20° C.) to 60° C. That is, the presence of appropriate proportions of low and high molecular weight components in the binder resin ensures that the specific toner is stable in viscosity and maintains moderate viscoelasticity at temperatures of 60° C. or below. The specific toner, having the characteristics specified above, is therefore stable in viscosity and has moderate viscoelasticity at temperatures from room temperature to 60° C.

An electrophotographic image forming apparatus forms an image on a recording medium by forming an electrostatic charge image on the surface of an electrophotographic photoreceptor, developing the electrostatic charge image using a developer that includes toner for developing an electrostatic charge image and thereby forming a toner image for developing an electrostatic charge image, transferring the toner image for developing an electrostatic charge image from the electrophotographic photoreceptor to the surface of the recording medium, and then fixing the toner image for developing an electrostatic charge image. After the transfer of the toner image for developing an electrostatic charge image, a cleaning section cleans the surface of the electrophotographic photoreceptor to remove, for example, any residue of the toner for developing an electrostatic charge image not transferred but left there. The cleaning section cleans the surface of the electrophotographic photoreceptor by contacting the surface with a cleaning blade.

Specific image forming apparatuses of the related art, however, can suffer streak-shaped image defects during repeated image formation. It is unclear what exactly causes them, but the inventors speculate as follows.

Possible Reason 1 for the Streak-Shaped Image Defects: Low Toner Viscoelasticity A specific image forming apparatus of the related art cleans off, for example, residue of the toner for developing an electrostatic charge image (hereinafter also referred to as "residual toner") on the surface of its electrophotographic photoreceptor by contacting a cleaning blade on the surface of the surface-protecting layer on the electrophotographic photoreceptor. If the toner for developing an electrostatic charge image has little viscoelasticity, this process can cause the residual toner to be crushed by the surface-protecting layer and cleaning blade of the specific image forming apparatus. The crushed residual toner cannot be removed, adhere to the surface of the electrophotographic photoreceptor, and form film (hereinafter also referred to as "filming"). Repeated image formation using a specific image forming apparatus can therefore result in a streak-shaped image defect on the surface of the electrophotographic photoreceptor. Image forming apparatuses that have an electrophotographic photoreceptor with a surface-protecting layer thereon tend to occur to this filming-related streak defect in comparison with image forming apparatuses whose photoreceptor has no surface-protecting layer.

A specific image forming apparatus according to this exemplary embodiment uses the aforementioned specific toner as the toner for developing an electrostatic charge image. The toner according to this exemplary embodiment is therefore not too low in viscoelasticity, and with such a toner the residual toner tends to be resistant to crushing by the surface-protecting layer and cleaning blade of the specific image forming apparatus. Therefore, the inventors believe, the specific image forming apparatus suppresses a filming and suppresses a filming-related streak image defect during repeated image formation.

Possible Reason 2 for the Streak-Shaped Image Defects: High Toner Viscoelasticity A specific image forming apparatus of the related art cleans off, for example, residue of the toner for developing an electrostatic charge image on the surface of its electrophotographic photoreceptor by contacting a cleaning blade on the surface of the surface-protecting layer on the electrophotographic photoreceptor. If the toner for developing an electrostatic charge image has high viscoelasticity, the residual toner, i.e., part of the toner left on the surface of the electrophotographic photoreceptor after transfer, can wear the cleaning blade or damage part of the cleaning blade. If this occurs, insufficient cleaning can result from some residual toner slipping between the cleaning blade and the electrophotographic photoreceptor. This can also result in a streak-shaped image defect. Image forming apparatuses that have an electrophotographic photoreceptor with a surface-protecting layer thereon tend to occur to this streak defect caused by passed residual toner in comparison with image forming apparatuses whose photoreceptor has no surface-protecting layer.

A specific image forming apparatus according to this exemplary embodiment uses a specified toner that has the characteristics mentioned above. The toner according to this exemplary embodiment is therefore not too high in viscoelasticity, and with such a toner the residual toner tends to be less wearing and damaging to the cleaning blade. Therefore, the inventors believe, the specific image forming apparatus suppresses a slipping of the residual toner between the cleaning blade and the electrophotographic photoreceptor and suppresses a streak-shaped image defect caused by passed residual toner even during repeated image formation.

The inventors believe this is the way a specific image forming apparatus according to this exemplary embodiment reduces both types of streak-shaped image defects, respectively caused by filming and passed residual toner.

The following describes the structure of an image forming apparatus according to this exemplary embodiment in detail.

An image forming apparatus according to this exemplary embodiment includes an image carrier that includes a conductive substrate and a photosensitive layer and a surface-protecting layer; a charging section that charges the surface of the image carrier; a latent-image-forming section that forms an electrostatic latent image on the image carrier; a developing section that forms a toner image by developing the electrostatic latent image using toner for electrostatic charge image development; a transfer section that transfers the toner image to a recording medium; and a cleaning section that removes residual toner on the surface of the image carrier using a cleaning blade.

The scope of application of an image forming apparatus according to this exemplary embodiment includes known types of image forming apparatuses, such as direct transfer apparatuses, which operate by forming a toner image for the development of an electrostatic charge image on the surface of an electrophotographic photoreceptor and transferring it directly to a recording medium; intermediate transfer apparatuses, which operate by forming a toner image for the development of an electrostatic charge image on the surface of an electrophotographic photoreceptor, transferring it to the surface of an intermediate transfer body (first transfer), and then transferring the toner image for the development of an electrostatic charge image on the surface of the intermediate transfer body to the surface of a recording medium (second transfer); and apparatuses that include a static eliminator, a device that removes static electricity from the surface of the electrophotographic photoreceptor by irradiation with antistatic light between the transfer of a toner image for electrostatic charge image development and charging.

If the apparatus is of intermediate transfer type, the transfer device has, for example, an intermediate transfer body, a first transfer device, and a second transfer device. A toner image formed on the surface of the electrophotographic photoreceptor is transferred by the first transfer device to the surface of the intermediate transfer body (first transfer). The toner image transferred to the surface of the intermediate transfer body is then transferred by the second transfer device to the surface of a recording medium (second transfer).

An image forming apparatus according to this exemplary embodiment may have a cartridge structure, a structure that allows the part to be attached to and detached from the image forming apparatus (i.e., may be a process cartridge).

The following describes an example of an image forming apparatus according to this exemplary embodiment. It should be noted that this is not the only example. The following description is focused on the structural elements illustrated in the drawings.

FIG. 1 schematically illustrates the structure of an example of an image forming apparatus according to this exemplary embodiment.

An image forming apparatus 10 according to this exemplary embodiment includes, for example, an electrophotographic photoreceptor 12 as illustrated in FIG. 1. The electrophotographic photoreceptor 12 is cylindrical and is coupled to a driver 27, such as a motor, by a transmitter of driving force (not illustrated), such as gears. The driver 27 rotates the electrophotographic photoreceptor 12 around the axis indicated by a black dot. In FIG. 1, the electrophotographic photoreceptor 12 is rotated in the direction of arrow A.

Around the electrophotographic photoreceptor 12 are, for example, a charging device 15 (example of a charging section), an electrostatic charge image forming device 16 (example of an electrostatic charge image forming section), a developing device 18 (example of a developing section), a transfer device 31 (example of a transfer section), a cleaning device 22 (example of a cleaning section), and an erasing device 24 in this order in the direction of rotation of the electrophotographic photoreceptor 12. The image forming apparatus 10 also includes a fixing device 26, which has a fixing member 26A and a pressure member 26B in contact with the fixing member 26A. The image forming apparatus 10, moreover, has a control device 36, which controls the operation of each device (section). The electrophotographic photoreceptor 12, charging device 15, electrostatic charge image forming device 16, developing device 18, transfer device 31, and cleaning device 22 are sections of an image forming unit.

The image forming apparatus 10 may have a process cartridge that includes at least the electrophotographic photoreceptor 12 and in which the electrophotographic photoreceptor 12 is integrated with other devices.

The following describes each device (section) of the image forming apparatus 10 in detail.

Electrophotographic Photoreceptor

The electrophotographic photoreceptor of an image forming apparatus according to this exemplary embodiment has a photosensitive layer and a surface-protecting layer on the photosensitive layer.

The photosensitive layer may be a single-layer photosensitive layer, which is one single functionally integrated photosensitive layer that contains both charge-generating and charge transporting materials, or may be a functionally divided multilayer photosensitive layer, formed by a charge generating layer and a charge transporting layer. The charge generating and charge transporting layers in a multilayer photosensitive layer may be in any order, but by way of example, the electrophotographic photoreceptor may have a charge generating layer, a charge transporting layer, and a surface-protecting layer in this order on a conductive substrate. The electrophotographic photoreceptor may include any other layer(s).

Figure 2:
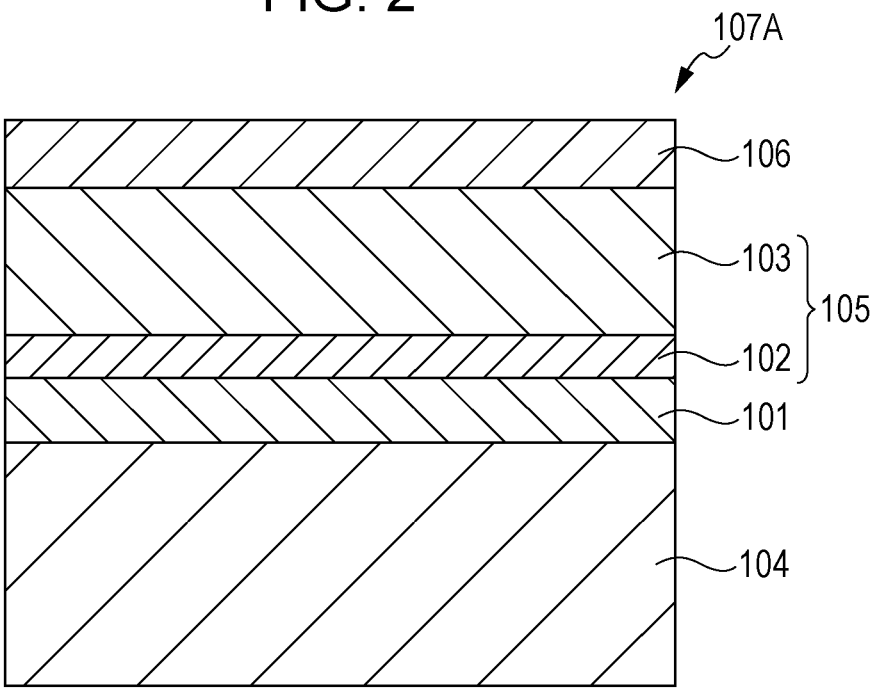
FIG. 2 is a schematic cross-section illustrating an example of a layer structure of the electrophotographic photoreceptor of an image forming apparatus according to this exemplary embodiment.

FIG. 2 is a schematic cross-section illustrating an example of a layer structure of the electrophotographic photoreceptor of an image forming apparatus according to this exemplary embodiment. The electrophotographic photoreceptor 107A has an undercoat layer 101 on a conductive substrate 104. On the undercoat layer 101 are a charge generating layer 102, a charge transporting layer 103, and a surface-protecting layer 106 formed one after another. The electrophotographic photoreceptor 107A has a photosensitive layer 105 functionally divided into the charge generating layer 102 and charge transporting layer 103.

Figure 3:
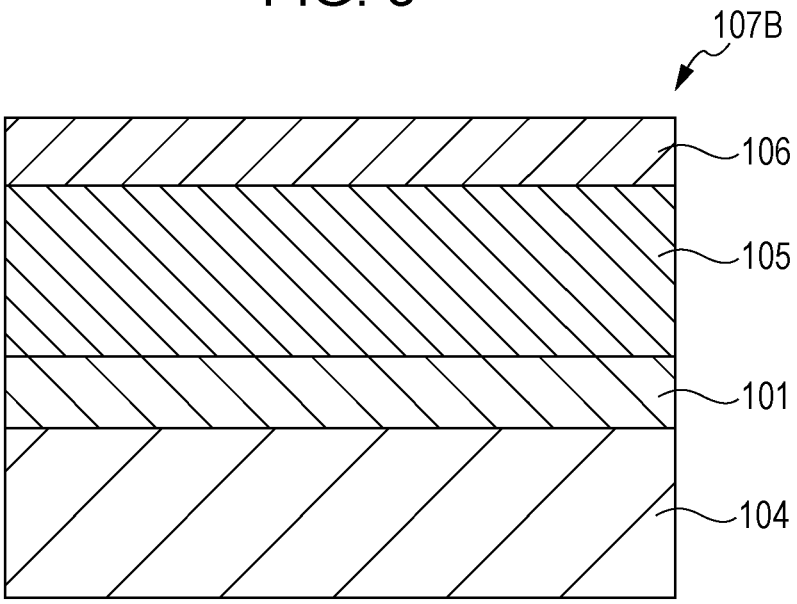
FIG. 3 is a schematic cross-section illustrating another example of a layer structure of the electrophotographic photoreceptor of an image forming apparatus according to this exemplary embodiment.

FIG. 3 is a schematic cross-section illustrating another example of a layer structure of the electrophotographic photoreceptor of an image forming apparatus according to this exemplary embodiment. The electrophotographic photoreceptor 107B in FIG. 3 has an undercoat layer 101 on a conductive substrate 104. On the undercoat layer 101 are a photosensitive layer 105 and a surface-protecting layer 106 formed one after another. The electrophotographic photoreceptor 107B has a single-layer photosensitive layer, which is one single functionally integrated photosensitive layer 105 that contains both charge generating and charge transporting materials.

The undercoat layer 101 is optional; it may be that an electrophotographic photoreceptor according to this exemplary embodiment has no undercoat layer.

The following describes the electrophotographic photoreceptor according to this exemplary embodiment in detail. In the following, the electrophotographic photoreceptor and its structural elements are mentioned without designators.

Conductive Substrate

The conductive substrate may be, for example, a metal plate, metal drum, or metal belt that contains a metal (e.g., aluminum, copper, zinc, chromium, nickel, molybdenum, vanadium, indium, gold, or platinum) or alloy (e.g., stainless steel). Alternatively, the conductive substrate may be, for example, a piece of paper, resin film, or belt with a layer of a conductive compound (e.g., a conductive polymer or indium oxide), metal (e.g., aluminum, palladium, or gold), or alloy thereon formed by coating, deposition, or lamination. The term "conductive" here means that the substrate has a volume resistivity of less than $10^{13}$ Ωcm.

If the electrophotographic photoreceptor is used with a laser printer, the conductive substrate may have its surface roughened to a center-line average roughness Ra of 0.04 μm or more and 0.5 μm or less so that the interference fringes, which occur when the electrophotographic photoreceptor is irradiated with laser light, will weaken. The use of an incoherent source which does not have interference fringes, but even if such a light source is used, surface roughening extends the life of the electrophotographic photoreceptor by reducing defects caused by an uneven surface of the conductive substrate.

Examples of surface roughening methods include wet honing, which means spraying an aqueous suspension of an abrasive onto the support, centerless grinding, which is continuous grinding of the conductive substrate with a grindstone pressed against the substrate, and anodization.

Alternatively, a layer instead may be formed on the non-rough surface of the conductive substrate by dispersing a conductive or semiconducting powder in a resin and then applying the resin to the surface of the conductive substrate. The particles dispersed in the layer roughen the surface of the layer.

Surface roughening by anodization is to anodize a metal (e.g., aluminum) conductive substrate in an electrolyte solution and thereby to form an oxide film on the surface of the conductive substrate. The electrolyte solution may be, for example, a solution of sulfuric acid or oxalic acid. The porous anodic oxide film freshly formed by anodization, however, is chemically active, occurs to contamination, and greatly changes its resistance with changes in the environment where it is. This may be addressed by subjecting the porous anodic oxide film to a sealing process, in which the oxide film is exposed to high-pressure steam or put into boiling water (optionally with a salt of nickel or any other metal therein). Hydration seals the pores in the oxide film by swelling the volume of the film, and the resulting hydrated oxide is more stable than the initial oxide.

The thickness of the anodic oxide film may be, for example, 0.3 μm or more and 15 μm or less. This tends to give the film barrier properties against injection, and also tends to reduce the increase in residual potential after repeated use.

The conductive substrate may be treated with an acidic treatment fluid or by the boehmite process.

The treatment with an acidic treatment fluid may be, for example, as follows. First, an acidic treatment fluid containing phosphoric acid, chromic acid, and hydrofluoric acid is prepared. The percentages of phosphoric acid, chromic acid, and hydrofluoric acid in the acidic treatment fluid may be 10% by mass or more and 11% by mass or less, 3% by mass or more and 5% by mass or less, and 0.5% by mass or more and 2% by mass or less, respectively, and the total concentration of these acids may be 13.5% by mass or more and 18% by mass or less. The temperature at which the treatment is performed may be, for example, 42° C. or more and 48° C. or less. The thickness of the resulting coating may be 0.3 μm or more and 15 μm or less.

The boehmite process is performed by, for example, immersing the conductive substrate in purified water at 90° C. or more and 100° C. or less for 5 to 60 minutes or exposing the conductive substrate to heated steam at 90° C. or more and 120° C. or less for 5 to 60 minutes. The thickness of the resulting coating may be 0.1 μm or more and 5 μm or less. This coating may optionally be anodized using an electrolyte solution that dissolves little of the coating, such as a solution of adipic acid, boric acid, a borate, a phosphate, a phthalate, a maleate, a benzoate, a tartrate, or a citrate.

Undercoat Layer

The undercoat layer is, for example, a layer that contains inorganic particles and a binder resin.

The inorganic particles may be, for example, inorganic particles having a powder resistivity (volume resistivity) of $10^2$ Ωcm or more and $10^{11}$ Ωcm or less. Examples of inorganic particles having such a resistance value include particles of metal oxides, such as particles of tin oxide, titanium oxide, zinc oxide, and zirconium oxide. Particles of zinc oxide are preferred.

The specific surface area of the inorganic particles as measured by the Brunauer-Emmett-Teller (BET) method may be, for example, 10 $m^2/g$ or more.

The volume average diameter of the inorganic particles may be, for example, 50 nm or more and 2000 nm or less (preferably 60 nm or more and 1000 nm or less).

The amount of the inorganic particles may be, for example, 10% by mass or more and 80% by mass or less, preferably 40% by mass or more and 80% by mass or less, of the binder resin.

The inorganic particles may be surface-treated ones. Even a mixture of two or more types of inorganic particles with different surface treatments or diameters may be used.

Examples of surface treatment agents include silane coupling agents, titanate coupling agents, aluminum coupling agents, and surfactants. Silane coupling agents are preferred, more preferably amino-containing silane coupling agents.

Examples of amino-containing silane coupling agents include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

A mixture of two or more silane coupling agents may also be used. For example, an amino-containing silane coupling agent may be used in combination with an extra silane coupling agent, whether amino-containing or not. Examples of extra silane coupling agents include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment with a surface treatment agent may be by any known process. Both dry and wet processes are acceptable.

The amount of surface treatment agent used for the treatment may be, for example, 0.5% by mass or more and 10% by mass or less of the inorganic particles.

Besides the inorganic particles, the undercoat layer may contain an electron-accepting compound (acceptor compound) in view of the improvement of the long-term stability of electrical properties and carrier-blocking properties.

Examples of electron-accepting compounds include electron-transporting substances, such as chloranil, bromanil, and other quinone compounds; tetracyanoquinodimethane compounds; fluorenone compounds, such as 2,4,7-trinitrofluorenone and 2,4,5,7-tetranitro-9-fluorenone; 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)-1,3,4-oxadiazole, and other oxadiazole compounds; xanthone compounds; thiophene compounds; and 3,3',5,5'-tetra-t-butyldiphenoquinone and other diphenoquinone compounds.

Compounds having the anthraquinone structure may also be used as electron-accepting compounds. Examples of compounds having the anthraquinone structure include hydroxyanthraquinone compounds, aminoanthraquinone compounds, and aminohydroxyanthraquinone compounds, specifically anthraquinone, alizarin, quinizarin, anthrarufin, and purpurin.

The electron-accepting compound may be contained dispersed with the inorganic particles or adhering to the surface of the inorganic particles in the undercoat layer.

The adhesion of the electron-accepting compound to the surface of the inorganic particles may be achieved by, for example, a dry process or a wet process.

An example of a dry process is to attach the electron-accepting compound to the surface of the inorganic particles by adding drops of or spraying the compound, either directly or as a solution in an organic solvent, together with dry air or nitrogen gas while stirring the inorganic particles, for example with a high-shear mixer. The addition or spraying of the electron-accepting compound may be done at temperatures equal to or lower than the boiling point of the solvent. The added or sprayed electron-accepting compound may be baked at 100° C. or above. Any type of baking may be performed as long as electrophotographic properties are obtained under the selected temperature and time conditions.

The wet process is to attach the electron-accepting compound to the surface of the inorganic particles by dispersing the inorganic particles in a solvent, for example by stirring or sonication or using a sand mill, an attritor, or a ball mill, stirring the dispersion with the electron-accepting compound or dispersing the compound in the dispersion, and then removing the solvent. The removal of the solvent is achieved by, for example, filtration or distillation. After the removal of the solvent, the electron-accepting compound may be baked at 100° C. or above. Any type of baking may be performed as long as electrophotographic properties are obtained under the selected temperature and time conditions. A wet process may include removing water from the inorganic particles, for example while stirring and heating the particles in a solvent or boiling the particles with a solvent, before the addition of the electron-accepting compound.

The adhesion of the electron-accepting compound may be before or after the surface treatment of the inorganic particles with a surface treatment agent or may be simultaneous with the surface treatment with a surface treatment agent.

The amount of the electron-accepting compound may be, for example, 0.01% by mass or more and 20% by mass or less, preferably 0.01% by mass or more and 10% by mass or less, of the inorganic particles.

As for the binder resin in the undercoat layer, examples include known materials such as acetal resins (e.g., polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, epoxy resins, and other known polymer compounds; zirconium chelate compounds; titanium chelate compounds; aluminum chelate compounds; titanium alkoxide compounds; organic titanium compounds; and silane coupling agents.

Resins like electron-transporting resins, which have electron-transporting group(s), and conductive resins (e.g., polyanilines) are also examples of binder resins in the undercoat layer. The binder resin in the undercoat layer may be a resin insoluble in the solvent used to form the upper layer, preferably a resin obtained by reacting at least one resin selected from the group consisting of thermosetting resins, such as urea resins, phenolic resins, phenol-formaldehyde resins, melamine resins, urethane resins, unsaturated polyester resins, alkyd resins, and epoxy resins; polyamide resins, polyester resins, polyether resins, methacrylic resins, acrylic resins, polyvinyl alcohol resins, and polyvinyl acetal resins with a curing agent.

If two or more of these binder resins are used in combination, their proportions are determined as appropriate.

The undercoat layer may contain additives for improving electrical properties, environmental stability, and/or image quality.

Additives that may be used include known materials such as condensed polycyclic, azo, and other electron-transporting pigments, zirconium chelate compounds, titanium chelate compounds, aluminum chelate compounds, titanium alkoxide compounds, organic titanium compounds, and silane coupling agents. Silane coupling agents may be used for the surface treatment of the inorganic particles as mentioned above, but may further be contained in the undercoat layer as additives.

Examples of silane coupling agents as additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of aluminum chelate compounds include aluminum isopropylate, monobutoxyaluminum diisopropylate, aluminum butyrate, diethyl acetoacetate aluminum isopropylate, and aluminum tris(ethyl acetoacetate).

These additives may be used alone or as a mixture or polycondensate of multiple compounds.

The undercoat layer may have a Vickers hardness of 35 or more.

The surface roughness (ten-point height of irregularities) of the undercoat layer may be between 1/(4n) (where n is the refractive index of the upper layer) and ½ of the wavelength λ of the laser for exposure so that moiré will weaken.

The surface roughness of the undercoat layer may be adjusted by the addition of, for example, resin particles. The resin particles may be, for example, particles of a silicone resin or particles of a crosslinked polymethyl methacrylate resin. The surface roughness adjustment may alternatively be achieved by smoothing the surface of the undercoat layer. Smoothing methods that may be used include buffing, sandblasting, wet honing, and grinding.

The formation of the undercoat layer may be by any known method. An example is to form a coating of a liquid prepared by adding the above ingredients to a solvent (liquid for undercoat layer formation), dry the coating, and then optionally heat the coating.

Examples of solvents that may be used to prepare the liquid for undercoat layer formation include alcohol solvents, aromatic hydrocarbon solvents, halogenated hydrocarbon solvents, ketone solvents, ketone alcohol solvents, ether solvents, ester solvents, and other known organic solvents.

Specific examples of these solvents include common organic solvents, such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

In preparing the liquid for undercoat layer formation, the dispersion of the inorganic particles may be by a known method, such as a roller mill, ball mill, vibration ball mill, attritor, sand mill, colloid mill, or paint shaker.

The application of the liquid for undercoat layer formation to the conductive substrate may be by a usual method, such as blade coating, wire bar coating, spray coating, dip coating, bead coating, air knife coating, or curtain coating.

The thickness of the undercoat layer may be, for example, 15 μm or more, preferably 20 μm or more and 50 μm or less.

Intermediate Layer

Although not illustrated, there may be an intermediate layer between the undercoat layer and the photosensitive layer.

The intermediate layer is, for example, a layer that contains a resin. Examples of resins that may be used in the intermediate layer include acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, melamine resins, and other polymer compounds.

The intermediate layer may alternatively be a layer that contains an organometallic compound. Examples of organometallic compounds that may be used in an intermediate layer include those organometallic compounds that have, for example, a zirconium, titanium, aluminum, manganese, or silicon atom.

These compounds that may be used in the intermediate layer may be used alone or as a mixture or polycondensate of multiple compounds.

Preferably, the intermediate layer is a layer that contains an organometallic compound containing a zirconium or silicon atom.

The formation of the intermediate layer may be by any known method. An example is to form a coating of a liquid prepared by adding any of the above ingredients to a solvent (liquid for intermediate layer formation), dry the coating, and then optionally heat the coating.

The coating for the formation of the intermediate layer may be by a usual method, such as dip coating, push coating, wire bar coating, spray coating, blade coating, knife coating, or curtain coating.

The thickness of the intermediate layer may be, for example, 0.1 μm or more and 3 μm or less. An intermediate layer may be used as the undercoat layer.

Charge Generating Layer

The charge generating layer is, for example, a layer that contains a charge generating material and a binder resin. Alternatively, the charge generating layer may be a layer of a charge generating material formed by deposition. The use of an incoherent source, such as a light-emitting diode (LED) or organic electroluminescence (EL) image array, is an exemplary case in which a layer of a charge generating material formed by deposition may be used.

Examples of charge generating materials include bisazo, trisazo, and other azo pigments; dibromoanthanthrone and other annulated aromatic pigments; perylene pigments; pyrrolopyrrole pigments; phthalocyanine pigments; zinc oxide; and trigonal selenium.

To be responsive to light from a near-infrared laser, the charge generating material may be a metal phthalocyanine pigment or non-metal phthalocyanine pigment. Specific examples include those hydroxygallium phthalocyanines disclosed in, for example, Japanese Laid Open Patent Application Publication Nos. 5-263007 and 5-279591; those chlorogallium phthalocyanines disclosed in, for example, Japanese Laid Open Patent Application Publication No. 5-98181; those dichlorotin phthalocyanines disclosed in, for example, Japanese Laid Open Patent Application Publication Nos. 5-140472 and 5-140473; and those titanyl phthalocyanines disclosed in, for example, Japanese Laid Open Patent Application Publication No. 4-189873.

To be responsive to light from a near-ultraviolet laser, the charge generating material may be, for example, an annulated aromatic pigment, such as dibromoanthanthrone; a thioindigo pigment; a porphyrazine compound; zinc oxide; trigonal selenium; or any of those bisazo pigments disclosed in Japanese Laid Open Patent Application Publication Nos. 2004-78147 and 2005-181992.

These charge generating materials may be used even if the light source is an LED, organic EL image array, or other incoherent source having a central emission wavelength of 450 nm or more and 780 nm or less. If a thin photosensitive layer having a thickness of 20 μm or less is used in view of image resolution, however, the electric field strength in the photosensitive layer is high, and the injection of charge from the substrate often causes low charge, or the image defect called black spots. This is serious if the charge generating material is a p-type semiconductor and therefore easily produces dark current, for example if the charge generating material is trigonal selenium or a phthalocyanine pigment.

By contrast, n-type semiconductors, such as condensed aromatic pigments, perylene pigments, and azo pigments, do not easily produce dark current when used as charge generating materials. With such a charge generating material, therefore, the image defect called black spots is mitigated even if the photosensitive layer is thin. Examples of n-type charge generating materials include, but are not limited to, compounds (CG-1) to (CG-27) in paragraphs to of Japanese Laid Open Patent Application Publication No. 2012-155282.

Whether a charge generating material is n-type is determined by the polarity of the photocurrent that flows therethrough in the commonly used time-of-flight method. The material is n-type if the carrier electrons flow more easily therethrough than holes.

The binder resin in the charge generating layer is selected from a wide range of insulating resins. Alternatively, the binder resin may be selected from organic photoconductive polymers, such as poly-N-vinylcarbazole, polyvinylanthracene, polyvinylpyrene, and polysilanes.

Examples of binder resins include polyvinyl butyral resins, polyarylate resins (e.g., polycondensates of a bisphenol and an aromatic dicarboxylic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins. The term "insulating" here means that the resin has a volume resistivity of $10^{13}$ Ωcm or more.

One of these binder resins alone or a mixture of two or more are used.

The proportions of the charge generating material and the binder resin(s) may be between 10:1 and 1:10 in a mass ratio.

Besides these ingredients, the charge generating layer may contain known additives.

The formation of the charge generating layer may be by any known method. An example is to form a coating of a liquid prepared by adding the above ingredients to a solvent (liquid for charge generating layer formation), dry the coating, and then optionally heat the coating. The charge generating layer may alternatively be formed by the deposition of a layer of the charge generating material, particularly if the charge generating material is an annulated aromatic pigment or perylene pigment.

Examples of solvents that may be used to prepare the liquid for charge generating layer formation include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. One of these solvents may be used alone, or two or more may be used as a mixture.

The dispersion of particles (e.g., the charge generating material) in the liquid for charge generating layer formation may be through the use of, for example, a medium disperser, such as a ball mill, vibration ball mill, attritor, sand mill, or horizontal sand mill, or a mediumless disperser, such as a stirrer, sonicator, roller mill, or high-pressure homogenizer. The high-pressure homogenizer may be, for example, an impact homogenizer, which disperses materials by causing a liquid dispersion to hit itself or a wall at high pressure, or a shear homogenizer, which disperses materials by forcing them through a very narrow channel at high pressure.

This process of dispersion may be performed until the average particle diameter of the charge generating material in the liquid for charge generating layer formation is 0.5 μm or less, preferably 0.3 μm or less, more preferably 0.15 μm or less.

The application of the liquid for charge generating layer formation to the undercoat layer (or intermediate layer) may be by a usual method, such as blade coating, wire bar coating, spray coating, dip coating, bead coating, air knife coating, or curtain coating.

The thickness of the charge generating layer may be, for example, 0.1 μm or more and 5.0 μm or less, preferably 0.2 μm or more and 2.0 μm or less.

Charge Transporting Layer

The charge transporting layer is, for example, a layer that contains a charge transporting material and a binder resin. Alternatively, the charge transporting layer may be a layer that contains a polymeric charge transporting material.

Examples of charge transporting materials include electron-transporting compounds, such as p-benzoquinone, chloranil, bromanil, and anthraquinone, and other quinone compounds; tetracyanoquinodimethane compounds; 2,4,7-trinitrofluorenone and other fluorenone compounds; xanthone compounds; benzophenone compounds; cyanovinyl compounds; and ethylene compounds. Hole-transporting compounds, such as triarylamine compounds, benzidine compounds, arylalkane compounds, aryl-substituted ethylene compounds, stilbene compounds, anthracene compounds, and hydrazone compounds, are also examples of charge-transport materials that may be used. One of these charge-transport materials alone or two or more are used, but these are not the only charge-transport materials that may be used.

In view of charge mobility, the charge-transport material may be one of those triarylamine derivatives represented by structural formula (a-1) and those benzidine compounds represented by structural formula (a-2).

(a-1)

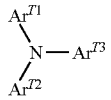

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, substituted or unsubstituted alkyl group, or substituted or unsubstituted aryl group.

Examples of substituents each of the above groups may have include halogen atoms, C1-5 alkyl groups, and C1-5 alkoxy groups. Amino groups substituted with C1-3 alkyl group(s) are also examples of possible substituents.

(a-2)

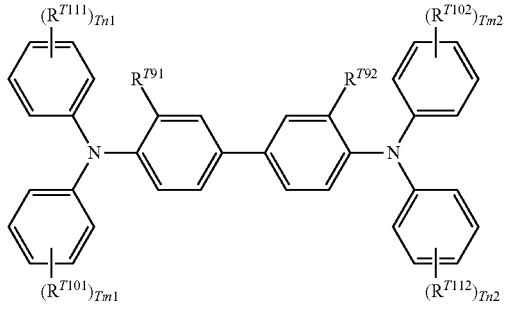

In structural formula (a-2), $R^{T91}$ and $R^{T92}$ each independently represent a hydrogen atom, halogen atom, C1-5 alkyl group, or C1-5 alkoxy group. $R_{T101}$, $R_{T102}$, $R^{T111}$, and $R^{T112}$ each independently represent a halogen atom, C1-5 alkyl group, C1-5 alkoxy group, amino group substituted with C1-2 alkyl group(s), substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$, and $R^{T16}$ each independently represent a hydrogen atom, substituted or unsubstituted alkyl group, or substituted or unsubstituted aryl group. Tm1, Tm2, Tn1, and Tn2 each independently represent an integer of 0 to 2.

Examples of substituents each of the above groups may have include halogen atoms, C1-5 alkyl groups, and C1-5 alkoxy groups. Amino groups substituted with C1-3 alkyl group(s) are also examples of possible substituents.

Of those triarylamine derivatives represented by structural formula (a-1) and those benzidine derivatives represented by structural formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" are preferred in view of charge mobility.

Examples of polymeric charge-transport materials include poly-N-vinylcarbazole, polysilanes, and other known polymeric charge transporters. Those polyester charge-transport materials disclosed in, for example, Japanese Unexamined Patent Application Publication Nos. 8-176293 and 8-208820 may also be used. Polymeric charge-transport materials may be used alone but may alternatively be used in combination with a binder resin.

Examples of binder resins that may be used in the charge-transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazole, and polysilanes. Preferably, the binder resin is a polycarbonate or polyarylate resin. One of these binder resins alone or two or more are used.

The proportions of the charge-transport material and the binder resin(s) may be between 10:1 and 1:5 in a mass ratio.

Besides these ingredients, the charge transporting layer may contain known additives.

The formation of the charge transporting layer may be by any known method. An example is to form a coating of a liquid prepared by adding the above ingredients to a solvent (liquid for charge-transport layer formation), dry the coating, and then optionally heat the coating.

Examples of solvents that may be used to prepare the liquid for charge transporting layer formation include common organic solvents, such as benzene, toluene, xylene, chlorobenzene, and other aromatic hydrocarbons; acetone, 2-butanone, and other ketones; methylene chloride, chloroform, ethylene chloride, and other halogenated aliphatic hydrocarbons; tetrahydrofuran, ethyl ether, and other cyclic or linear ethers. One of these solvents alone or a mixture of two or more is used.

The application of the liquid for charge transporting layer formation to the charge generating layer may be by a usual method, such as blade coating, wire bar coating, spray coating, dip coating, bead coating, air knife coating, or curtain coating.

The thickness of the charge transporting layer may be, for example, 5 μm or more and 50 μm or less, preferably 10 μm or more and 30 μm or less.

Surface-Protecting Layer

The surface-protecting layer (hereinafter also simply referred to as the "protecting layer") is on the photosensitive layer. The protecting layer is intended to, for example, prevent chemical alteration of a charged photosensitive layer and/or further improve the mechanical strength of the photosensitive layer. The protecting layer may therefore be a layer of cured coating (crosslinked coating). The layers specified below as 1) and 2) are examples of such layers.

1) A layer of coating formed by curing a composition that contains at least one material having a reactive group and a charge-transporting structure in the same molecule (reactive-group-containing charge-transport material). That is, a layer containing a polymer or the crosslinked form of the reactive-group-containing charge-transport material.

2) A layer of coating formed by curing a composition that contains a nonreactive charge-transport material and a material having a reactive group and no charge-transporting structure (reactive-group-containing non-charge-transport material). That is, a layer containing the nonreactive charge-transport material and a polymer or the crosslinked form of the reactive-group-containing non-charge-transport material.

Examples of reactive groups include known reactive groups, such as a group capable of chain polymerization, the epoxy group, —OH, —OR [where R represents an alkyl group], —$NH_2$, —SH, —COOH, and —$SiR^{Q1}_{3-Qn}(OR^{Q2})_{Qn}$ [where $R^{Q1}$ represents a hydrogen atom, alkyl group, or substituted or unsubstituted aryl group, $R^{Q2}$ represents a hydrogen atom, alkyl group, or trialkylsilyl group, and Qn represents an integer of 1 to 3]. These known reactive groups are also examples of reactive groups that may be used in a reactive-group-containing non-charge-transport material.

The group capable of chain polymerization may be any radically polymerizable functional group. An example is a functional group that has a group containing a carbon double bond. Specific examples of functional groups that have a group containing a carbon double bond include groups that contain at least one selected from a vinyl group, a vinyl ether group, a vinyl thioether group, a styryl (vinylphenyl) group, an acryloyl group, a methacryloyl group, and derivatives thereof. The group capable of chain polymerization is preferably a group that contains at least one selected from a vinyl group, a styryl (vinylphenyl) group, an acryloyl group, a methacryloyl group, and derivatives thereof by the characteristic of its superior reactivity, more preferably a group that contains at least one selected from an acryloyl group, a methacryloyl group, and derivatives thereof, even more preferably a group that contains at least one of an acryloyl group and a methacryloyl group.

The charge-transporting structure may be any such structure known to be used in an electrophotographic photoreceptor. Examples include structures derived from a nitrogen-containing hole-transporting compound, such as a triarylamine compound, benzidine compound, or hydrazone compound, and forming a conjugated system with the nitrogen atom(s). Preferably, the charge-transporting structure is a triarylamine structure.

The reactive-group-containing charge-transport material, nonreactive charge-transport material, and reactive-group-containing non-charge-transport material may be selected from known materials.

Of 1) and 2), the surface-protecting layer is preferably 1) the cured form of a composition that contains a material having a reactive group and a charge-transporting structure in the same molecule (reactive-group-containing charge-transport material).

A surface-protecting layer that is 1) the cured form of a composition that contains a material having a reactive group and a charge-transporting structure in the same molecule (reactive-group-containing charge-transport material) tends to exhibit a high hardness in comparison with a surface-protecting layer that is a layer of the cured form of a composition specified in 2). A high hardness of the surface-protecting layer tends to result in a higher incidence of a streak-shaped image defect caused by filming and that caused by passed residual toner. In this exemplary embodiment, the use of a toner for electrostatic charge image development according to this exemplary embodiment reduces both the streak-shaped image defect caused by filming and that caused by passed residual toner even if the image forming apparatus includes an electrophotographic photoreceptor that has a high-hardness surface-protecting layer.

The reactive-group-containing charge-transport material may include a reactive-group-containing charge-transport material that has at least one of an acryloyl group and a methacryloyl group as reactive group(s) (hereinafter also referred to as a "specific reactive-group-containing charge-transport material (a)").

Including a specific reactive-group-containing charge-transport material (a) in the reactive-group-containing charge-transport material tends to result in a higher hardness of the surface-protecting layer. As mentioned above, a high hardness of the surface-protecting layer tends to result in a higher incidence of a streak-shaped image defect caused by filming and that caused by passed residual toner. In this exemplary embodiment, the use of a toner according to this exemplary embodiment reduces both the streak-shaped image defect caused by filming and that caused by passed residual toner even if the image forming apparatus includes an electrophotographic photoreceptor that has a high-hardness surface-protecting layer.

Specific Reactive-Group-Containing Charge-Transport Material (a)

A specific reactive-group-containing charge-transport material (a) used in the surface-protecting layer is a compound that has a charge-transporting structure and an acryloyl or methacryloyl group in the same molecule and may be any compound that meets these structural criteria.

Preferably, the specific reactive-group-containing charge-transport material (a) is a compound having a methacryloyl group. The reason for this is unclear, but the inventors speculate as follows. Usually, curing is performed using a compound that has the highly reactive acryloyl group. If the bulky charge-transporting structure has the highly reactive acryloyl group as a substituent, it is likely that nonuniform curing reaction will cause the resulting cured coating, or the surface-protecting layer, to be uneven and creased. The use of a specific reactive-group-containing charge-transport material (a) that has a methacryloyl group, which is less reactive than an acryloyl group, appears to help prevent such unevenness of and creases in the surface-protecting layer as the cured coating.

The specific reactive-group-containing charge-transport material (a) may have a structure that includes one or more carbon atoms between the charge-transporting structure and the acryloyl or methacryloyl group. In other words, the specific reactive-group-containing charge-transport material (a) may have a carbon chain containing one or more carbon atoms, in particular an alkylene group, as a linking group between the charge-transporting structure and the acryloyl or methacryloyl group.

It is unclear what exactly this form provides, but the following may be a possible reason for choosing it. Regarding the mechanical strength of the surface-protecting layer, a reactive-group-containing charge-transport material is rigid if its bulky charge-transporting structure is close to its site for polymerization (acryloyl or methacryloyl group). This type of rigidity, the inventors believe, can reduce the chance of reaction by restricting the movement of the site for polymerization.

The specific reactive-group-containing charge-transport material (a), moreover, may be a compound (a') that has a triphenylamine structure and three or more, preferably four or more, methacryloyl groups in the same molecule. In this form, the compound tends to be stable during synthesis. This form, moreover, helps obtain a thick surface-protecting layer because the resulting surface-protecting layer will have sufficiently high mechanical strength by the characteristic of a high crosslink density.

In this exemplary embodiment, the specific reactive-group-containing charge-transport material (a) may be a compound represented by general formula (A). Such compounds are superior in the ability to transport charge.

(A)

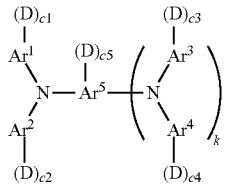

In general formula (A), $Ar^1$ to $Ar^4$ each independently represent a substituted or unsubstituted aryl group, $Ar^5$ represents a substituted or unsubstituted aryl or substituted or unsubstituted arylene group, D represents $—(CH_2)_d—(O—CH_2—CH_2)_e—O—CO—C(CH_3)=CH_2$, c1 to c5 each independently represent an integer of 0 to 2, k represents 0 or 1, d represents an integer of 0 to 5, e represents 0 or 1, and the total number of Ds is 4 or more.

In general formula (A), $Ar^1$ to $Ar^4$ each independently represent a substituted or unsubstituted aryl group. Each of $Ar^1$ to $Ar^4$ may be same or different.

Examples of substituents a substituted aryl group may have, excluding D ($—(CH_2)_d—(O—CH_2—CH_2)_e—O—CO—C(CH_3)=CH_2$)), include C1-4 alkyl or alkoxy groups and substituted or unsubstituted C6-10 aryl groups.

Each of $Ar^1$ to $Ar^4$ may be one of formulae (1) to (7). In formulae (1) to (7), "$-(D)_c$" is a generic representation for "$-(D)_{c1}$" to "$-(D)_{c4}$," groups that may be linked to $Ar^1$ to $Ar^4$, respectively.

(1)

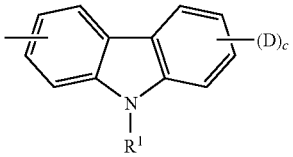

(2)

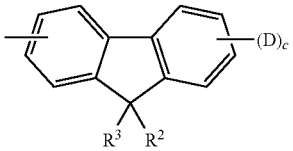

(3)

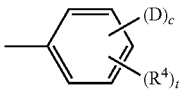

(4)

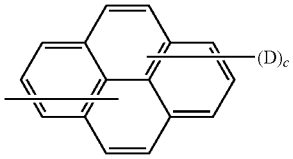

(5)

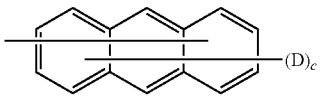

-continued (6)

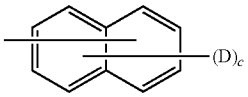

(7)

In formulae (1) to (7), $R^1$ represents one selected from the group consisting of a hydrogen atom, a C1-4 alkyl group, a phenyl group substituted with a C1-4 alkyl or C1-4 alkoxy group, an unsubstituted phenyl group, and a C7-10 aralkyl group, $R^2$ to $R^4$ each independently represent one selected from the group consisting of a hydrogen atom, a C1-4 alkyl group, a C1-4 alkoxy group, a phenyl group substituted with a C1-4 alkoxy group, an unsubstituted phenyl group, a C7-10 aralkyl group, and a halogen atom, Ar represents a substituted or unsubstituted arylene group, D represents $—(CH_2)_d—(O—CH_2—CH_2)_e—O—CO—C(CH_3)=CH_2$, c represents 1 or 2, s represents 0 or 1, and t represents an integer of 0 to 3.

Ar in formula (7) may be a group represented by structural formula (8) or (9).

(8)

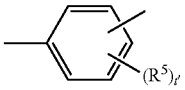

(9)

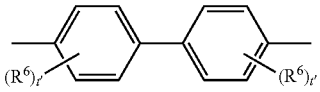

In formulae (8) and (9), $R^5$ and $R^6$ each independently represent one selected from the group consisting of a hydrogen atom, a C1-4 alkyl group, a C1-4 alkoxy group, a phenyl group substituted with a C1-4 alkoxy group, an unsubstituted phenyl group, a C7-10 aralkyl group, and a halogen atom, and each t' represents an integer of 0 to 3.

In formula (7), Z' represents a divalent organic linking group and may be one of those groups represented by formulae (10) to (17). In formula (7), each s represents 0 or 1.

(10)

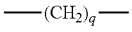

(11)

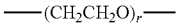

(12)

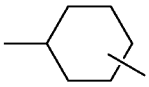

(13)

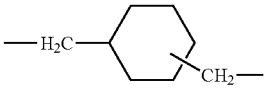

(14)

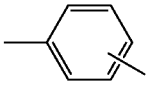

(15)

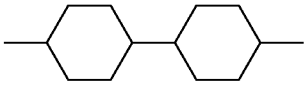

-continued (16)

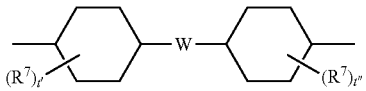

(17)

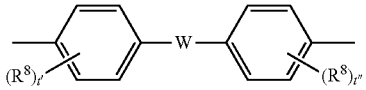

In formulae (10) to (17), $R^7$ and $R^8$ each independently represent one selected from the group consisting of a hydrogen atom, a C1-4 alkyl group, a C1-4 alkoxy group, a phenyl group substituted with a C1-4 alkoxy group, an unsubstituted phenyl group, a C7-10 aralkyl group, and a halogen atom, W represents a divalent group, q and r each independently represent an integer of 1 to 10, and each t" represents an integer of 0 to 3.

W in formulae (16) and (17) may be one of those divalent groups represented by formulae (18) to (26). In formula (25), u represents an integer of 0 to 3.

(18) $—CH_2—$

(19) $—C(CH_3)_2—$

(20) —O—

(21) —S—

(22) $—C(CF_3)_2—$

(23) $—Si(CH_3)_2—$ (24)

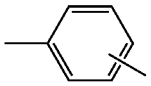

(25)

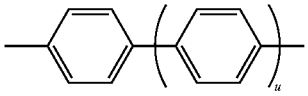

(26)

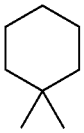

In general formula (A), $Ar^5$ is a substituted or unsubstituted aryl group if k is 0. Examples of aryl groups in this case are the same as those mentioned by way of example in the description of $Ar^1$ to $Ar^4$. If k is 1, $Ar^5$ is a substituted or unsubstituted arylene group. Examples of arylene groups in this case include arylene groups resulting from removing a hydrogen atom from an aryl group mentioned by way of example in the description of $Ar^1$ to $Ar^4$ to make the position for $—N(Ar^3\text{-}(D)_{c3})(Ar^4\text{-}(D)_{c4})$ available.

Specific examples of compounds represented by general formula (A) include the compounds described in paragraphs to of Japanese Laid Open Patent Application Publication No. 2018-4968.

Examples of methods for producing a compound represented by general formula (A) include the method described in paragraphs to of Japanese Laid Open Patent Application Publication No. 2018-4968.

The reactive charge-transport material may include a compound that is not a specific reactive-group-containing charge-transport material (a) (hereinafter also referred to as a "general reactive charge-transport material (a")). An example of a general charge-transport material is a compound resulting from introducing an acryloyl or methacryloyl group to a known charge-transport material.

The percentage of specific reactive-group-containing charge-transport materials (a) to all reactive-group-containing charge-transport materials may be 90% by mass or more and 100% by mass or less, preferably 98% by mass or more and 100% by mass or less.

The amount of the reactive-group-containing charge-transport material may be 30% by mass or more and 100% by mass or less, preferably 40% by mass or more and 100% by mass or less, even more preferably 50% by mass or more and 100% by mass or less, of the composition (solids content) used to form the surface-protecting layer. A percentage in these ranges ensures that the cured coating has excellent electrical properties and also helps produce a thin cured coating.

The hardness (universal hardness) of the surface-protecting layer may be 140 $N/mm^2$ or more and 300 $N/mm^2$ or less, preferably 160 $N/mm^2$ or more and 280 $N/mm^2$ or less, even more preferably 180 $N/mm^2$ or more and 260 $N/mm^2$ or less.

A hardness of the surface-protecting layer in these ranges tends to result in a surface-protecting layer with a high degree of hardness. As mentioned above, an image forming apparatus that includes an electrophotographic photoreceptor having a high-hardness surface-protecting layer tends to occur to a streak-shaped image defect caused by filming and that caused by passed residual toner. In this exemplary embodiment, the use of a toner for electrostatic charge image development according to this exemplary embodiment reduces both the streak-shaped image defect caused by filming and that caused by passed residual toner even if the image forming apparatus includes an electrophotographic photoreceptor that has a high-hardness surface-protecting layer.

The universal hardness of the surface-protecting layer is that measured as follows.

A hardness test is performed using a Vickers pyramidal diamond indenter under 25° C. and 50% relative humidity (RH) conditions. The universal hardness at a maximum load of 20 mN is the universal hardness of the surface-protecting layer.

Details of the Measurement

The measuring instrument is Fischer Instruments FISCHERSCOPE H100V (microhardness tester). The indenter for measurement is a Vickers pyramidal diamond indenter with an angle of 136° between opposite faces.

Measurement Conditions

Loading conditions: The surface of the surface-protecting layer of the electrophotographic photoreceptor is indented with the Vickers indenter at a rate of 4 mN/sec.

Loading time: 5 seconds.

Dwell time: 5 seconds.

Unloading conditions: The load is removed at the same rate as in loading.

As for the specimen for measurement, a produced electrophotographic photoreceptor is mounted on the H100V, the surface of the surface-protecting layer is indented vertically with the Vickers indenter, and measurement is performed. The procedure for measurement is to load with the indenter (5 sec), dwell (5 sec), and then unload.

Besides these ingredients, the protecting layer may contain known additives.

The formation of the protecting layer may be by any known method. An example is to form a coating of a liquid prepared by adding the above ingredients to a solvent (liquid for protecting layer formation), dry the coating, and then optionally perform curing, for example by heating.

Examples of solvents that may be used to prepare the liquid for protecting layer formation include aromatic solvents, such as toluene and xylene; ketone solvents, such as methyl ethyl ketone, methyl isobutyl ketone, and cyclohexanone; ester solvents, such as ethyl acetate and butyl acetate; ether solvents, such as tetrahydrofuran and dioxane; cellosolve solvents, such as ethylene glycol monomethyl ether; and alcohol solvents, such as isopropyl alcohol and butanol. These solvents are used alone or as a mixture of two or more. The liquid for protecting layer formation, however, may be a solventless liquid.

The application of the liquid for protecting layer formation to the photosensitive layer (e.g., the charge-transport layer) may be by a usual method, such as dip coating, push coating, wire bar coating, spray coating, blade coating, knife coating, or curtain coating.

The thickness of the protecting layer may be, for example, 1 μm or more and 20 μm or less, preferably 2 μm or more and 10 μm or less.

Single-Layer Photosensitive Layer

A single-layer photosensitive layer (chargegenerating/charge transporting layer) is a layer that contains, for example, a charge-generating material and a charge-transport material and optionally a binder resin and known additives. The details of these materials are as described for those in the charge generating layer and the charge transporting layer.

In the single-layer photosensitive layer, the amount of the charge-generating material may be 0.1% by mass or 10% by mass or less, preferably 0.8% by mass or more and 5% by mass or less, of the total solids content, and the amount of the charge-transport material may be 5% by mass or more and 50% by mass or less of the total solids content.

As for formation, examples of possible methods are the same as those for the formation of a charge generating layer or a charge transporting layer.

The thickness of the single-layer photosensitive layer may be, for example, 5 μm or more and 50 μm or less, preferably 10 μm or more and 40 μm or less.

Charging Device

The charging device 15 charges the surface of the electrophotographic photoreceptor 12. The charging device 15 includes, for example, a charging member 14 and a power supply 28. The charging member 14 charges the surface of the electrophotographic photoreceptor 12, whether it contacts or does not contact the surface of the electrophotographic photoreceptor 12, and the power supply 28 applies a charging voltage to the charging member 14 (example of a voltage supplier for the charging member). The power supply 28 is electrically coupled to the charging member 14.

The charging member 14 of the charging device 15 may be, for example, a contact charger that uses a conductive charging roller, charging brush, charging film, charging rubber blade, charging tube, etc. Alternatively, the charging member 14 may be, for example, a noncontact roller charger, a scorotron or corotron charger, which uses a corona discharge, or any other charger known in itself.

Electrostatic-Charge-Image-Forming Device

The electrostatic-charge-image-forming device 16 forms an electrostatic charge image on the charged surface of the electrophotographic photoreceptor 12. To be more specific, the electrostatic-charge-image-forming device 16 emits light L toward the surface of the electrophotographic photoreceptor 12 charged by the charging member 14. The light L has been modulated on the basis of image information of the image to be formed. As a result, an electrostatic charge image is formed on the electrophotographic photoreceptor 12 in accordance with the image of the image information.

The electrostatic-charge-image-forming device 16 may be, for example, a piece of optical equipment that has a light source with which a target can be exposed to a pattern of light, for example from a semiconductor laser, an LED, or through a liquid crystal shutter.

Developing Device

The developing device 18 is located, for example, downstream of the point of the irradiation with light L by the electrostatic-charge-image-forming device 16 in the direction of rotation of the electrophotographic photoreceptor 12. Inside the developing device 18 is a container for a developing agent. The container contains a developer that has a specific toner (electrostatic-charge-image developer). In an exemplary configuration, the toner is contained charged in the developing device 18.

The developing device 18 includes, for example, a developing member 18A and a power supply 32. The developing member 18 develops the electrostatic charge image formed on the surface of the electrophotographic photoreceptor 12 with a developer that includes toner for electrostatic charge image development, and the power supply 32 applies a developing voltage to the developing member 18A. The developing member 18A is, for example, electrically coupled to the power supply 32.

The developing member 18A of the developing device 18 is selected in accordance with the type of developer used. An example is a developing roller that has a developing sleeve with a built-in magnet.

The developing device 18 (including the power supply 32) is electrically coupled to, for example, a control device 36 that is part of the image forming apparatus 10. Under the control of the control device 36, the developing device 18 applies a developing voltage to the developing member 18A. The application of a developing voltage makes the developing member 18A charged to a developing potential determined by the developing voltage. The developing member 18A charged to a developing potential then supplies the toner, included in the developer contained in the developing device 18, from the inside of the developing device 18 to the surface of the electrophotographic photoreceptor 12, for example by retaining the developer on its surface. On the surface of the electrophotographic photoreceptor 12, fed with the toner, the electrostatic charge image formed thereon is developed into a toner image.

Transfer Device

The transfer device 31 is located, for example, downstream of the developing member 18A in the direction of rotation of the electrophotographic photoreceptor 12. The transfer device 31 includes, for example, a transfer member 20 and a power supply 30. The transfer member 20 transfers the toner image formed on the surface of the electrophotographic photoreceptor 12 to a recording medium 30A, and the power supply 30 applies a transfer voltage to the transfer member 20. The transfer member 20 is, for example, cylindrical, and the electrophotographic photoreceptor 12 and the transfer member 20 transport the recording medium 30A by sandwiching it therebetween. The transfer member 20 is, for example, electrically coupled to the power supply 30.

The transfer member 20 may be, for example, a contact transfer charger that uses a belt, roller, film, rubber cleaning blade, etc., or may be a noncontact transfer charger known in itself, such as a scorotron or corotron transfer charger, which uses a corona discharge.

The transfer device 31 (including the power supply 30) is electrically coupled to, for example, a control device 36 that is part of the image forming apparatus 10. Under the control of the control device 36, the transfer device 31 applies a transfer voltage to the transfer member 20. The application of a transfer voltage makes the transfer member 20 charged to a transfer potential determined by the transfer voltage.

The transfer voltage has the opposite polarity to the toner forming the toner image on the electrophotographic photoreceptor 12. The application of the transfer voltage by the power supply 30 of the transfer member 20 to the transfer member 20 produces, for example, a transfer electric field in the region in which the electrophotographic photoreceptor 12 and the transfer member 20 face each other (see the transfer region 32A in FIG. 1). The transfer electric field has a field strength that provides an electrostatic force that moves each particle of the toner forming the toner image on the electrophotographic photoreceptor 12 from the electrophotographic photoreceptor 12 to the transfer member 20.

The recording medium 30A reaches the transfer region 32A, the region in which the electrophotographic photoreceptor 12 and the transfer member 20 face each other, for example by being transported by multiple transport members not illustrated from its container, not illustrated, along a transport route 34. In FIG. 1, the recording medium 30A is transported in the direction of arrow B. While the recording medium 30A is in the transfer region 32A, the toner image on the electrophotographic photoreceptor 12 is transferred thereto, for example by the transfer electric field produced in that region by the transfer voltage applied to the transfer member 20. That is, the toner image is transferred to the recording medium 30A, for example by the toner moving from the surface of the electrophotographic photoreceptor 12 to the recording medium 30A. Then the toner image on the electrophotographic photoreceptor 12 is transferred to the recording medium 30A by the transfer electric field.

Cleaning Device

The cleaning device 22 is located downstream of the transfer region 32A in the direction of rotation of the electrophotographic photoreceptor 12. After the transfer of the toner image to the recording medium 30A, the cleaning device 22 cleans residual toner off the electrophotographic photoreceptor 12. Besides residual toner, the cleaning device 22 cleans off any adhering substance, such as paper fibers.

The cleaning device 22 has a cleaning blade 220. By cotacting the cleaning blade 220 on the surface of the electrophotographic photoreceptor 12 with its edge against the rotation of the electrophotographic photoreceptor 12, the cleaning device 22 removes any substance adhering to the surface of the electrophotographic photoreceptor 12.

Figure 4:
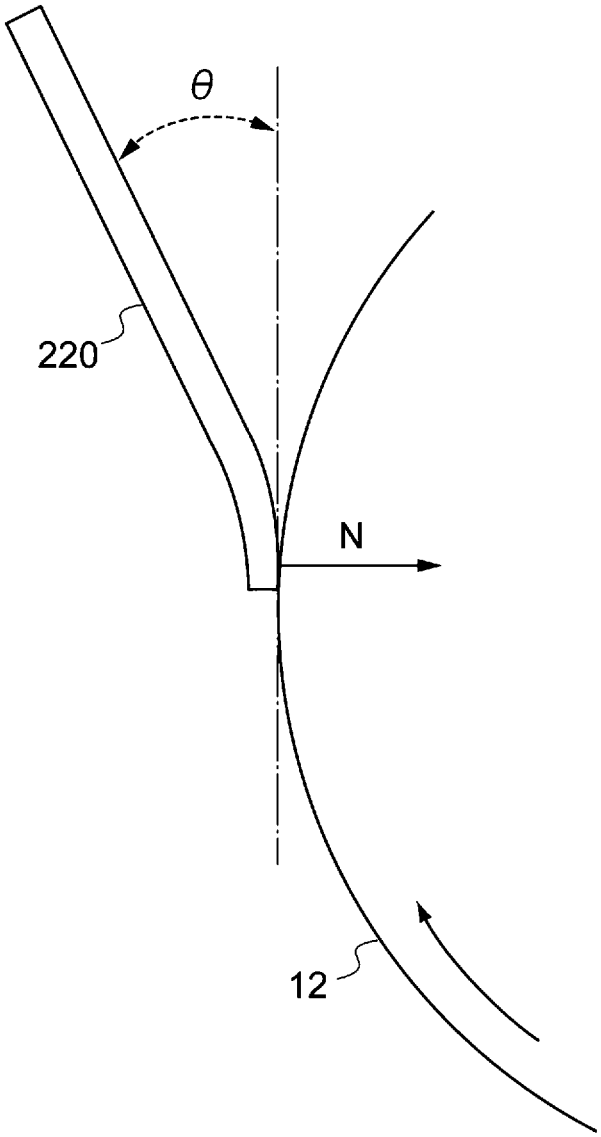
FIG. 4 is an enlarged view of the point of contact between the cleaning blade and the electrophotographic photoreceptor in the image forming apparatus illustrated in FIG. 1.

The following describes the cleaning device 22 with reference to FIG. 4.

FIG. 4 schematically illustrates a configuration of the cleaning blade 220 in the cleaning device 22 illustrated in FIG. 1.

As illustrated in FIG. 4, the edge of the cleaning blade 220 faces against the rotation of the electrophotographic photoreceptor (direction of the arrow) and in this state contacts the surface of the electrophotographic photoreceptor 12.

The angle θ between the cleaning blade 220 and the electrophotographic photoreceptor 12 may be 5° or more and 35° or less, preferably 10° or more and 25° or less.

The pressure N with which the cleaning blade 220 is pressed against the electrophotographic photoreceptor 12 may be 0.6 gf/mm$^2$ or more and 6.0 gf/mm$^2$ or less.

To be more specific, the angle θ represents, as illustrated in FIG. 4, the angle formed by the tangent to the point of the electrophotographic photoreceptor 12 at which it is contacted by the cleaning blade 220 (dash dot line in FIG. 4) and the non-deforming portion of the cleaning blade 220.

Likewise, the pressure N is, as illustrated in FIG. 4, the pressure (gf/mm$^2$) applied toward the center of the electrophotographic photoreceptor 12 at the point of the electrophotographic photoreceptor 12 at which it is contacted by the cleaning blade 220.

The cleaning blade 220 is supported by a support member (not illustrated in FIG. 4) joined to its surface opposite the surface with which it contacts the electrophotographic photoreceptor 12. By this support member, the cleaning blade 220 is pressed against the electrophotographic photoreceptor 12 with the aforementioned pressure. The support member may be, for example, a metal material, such as aluminum or stainless steel. There may be an adhesive layer, such as a layer of an adhesive agent, between the support member and the cleaning blade 220 to join them together.

Besides the cleaning blade 220 and a support member supporting it, the cleaning device may include a known member.

The cleaning blade may include a rubber plate at least in the portion where it contacts the electrophotographic photoreceptor. The cleaning blade may have a single-layer structure, in which the rubber plate is the only component, or may have a multilayer structure, which includes a back layer on the back (surface opposite the surface facing the electrophotographic photoreceptor) of the rubber plate. The back layer may have more than one layer.

The rubber plate contains rubber throughout its structure. The term "rubber" here refers to a polymer compound that has rubber elasticity at the ordinary temperature (25° C.). Examples of rubbers include polyurethane, silicone rubber, fluororubber, chloroprene rubber, and butadiene rubber. The rubber plate is preferably a piece of polyurethane, more preferably highly crystalline polyurethane.

Polyurethane is usually synthesized by polymerizing a polyisocyanate and a polyol. Besides the polyol, a resin that has an isocyanate-reactive functional group may be used. The polyurethane may have a hard segment and a soft segment.

The terms "hard segment" and "soft segment" here refer to segments of the polyurethane. The former is formed by a material relatively harder than the material forming the latter, and the latter is formed by a material relatively softer than the material forming the former.

The hard and soft segments may be formed by any combination of materials (hard-segment material and soft-segment material). Any two may be selected from known materials to make a combination in which the first material is relatively harder than the second, and the second is relatively softer than the first. Examples include the following combinations.

Soft-Segment Material

The soft-segment material may be a polyol, such as a polyester polyol, which is obtained by dehydration condensation between a diol and a dibasic acid, a polycarbonate polyol, obtained by reaction between a diol and an alkyl carbonate, a polycaprolactone polyol, or a polyether polyol.

Commercially available examples of such polyols that may be used as soft-segment materials include Daicel PLACCEL 205 and PLACCEL 240.

Hard-Segment Material

The hard-segment material may be a resin that has an isocyanate-reactive functional group. The resin may be a flexible resin, preferably a linear-chain aliphatic resin in view of flexibility. Specific examples of resins include acrylic resins that contain two or more hydroxyl groups, polybutadiene resins that contain two or more hydroxyl groups, and epoxy resins that have two or more epoxy groups.

Examples of commercially available acrylic resins that contain two or more hydroxyl groups include Soken Chemical & Engineering ACTFLOW (grades: UMB-2005B, UMB-2005P, UMB-2005, UME-2005, etc.).

Examples of commercially available polybutadiene resins that contain two or more hydroxyl groups include R-45HT from Idemitsu Kosan Co., Ltd.

If an epoxy resin that has two or more epoxy groups is used, the epoxy resin may be one that is more flexible and tougher than the ordinary, hard and brittle epoxy resins. In terms of molecular structure, examples of epoxy resins include those that have in their backbone structure a structure that can improve the mobility of the backbone (flexible structure). The flexible structure may be, for example, an alkylene structure, cycloalkane structure, or polyoxyalkylene structure, preferably a polyoxyalkylene structure.

In terms of physical characteristics, the epoxy resin may have low viscosity in comparison with the ordinary epoxy resins of the same molecular weight. To be more specific, the epoxy resin may have a weight-average molecular weight of 900±100 and may have a viscosity of 15000±5000 mPa·s, preferably 15000±3000 mPa·s at 25° C. Examples of commercially available epoxy resins having such characteristics include DIC's EPLICON EXA-4850-150.

If a hard-segment material and a soft-segment material are used, the percentage of the material forming the hard segment to the total quantity of the hard-segment and soft-segment materials (hereinafter referred to as "the hard-segment material content") may be 10% by mass or more and 30% by mass or less, preferably 13% by mass or more and 23% by mass or less, more preferably 15% by mass or more and 20% by mass or less.

A hard-segment material content of 10% by mass or more provides wear resistance. A hard-segment material content of 30% by mass or less prevents the rubber plate from being too hard, thereby ensuring that the rubber plate is flexible, stretchable, and therefore resistant to chipping.

Polyisocyanate

Examples of polyisocyanates that may be used to synthesize the polyurethane include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI).

Preferably, the polyisocyanate is 4,4'-diphenylmethane diisocyanate (MDI), 1,5-naphthalene diisocyanate (NDI), or hexamethylene diisocyanate (HDI) in view of ease of forming hard-segment aggregates of an appropriate size (particle diameter).

The amount of the polyisocyanate per 100 parts by mass of resins that have an isocyanate-reactive functional group may be 20 parts by mass or more and 40 parts by mass or less, preferably 20 parts by mass or more and 35 parts by mass or less, more preferably 20 parts by mass or more and 30 parts by mass or less.

The use of 20 parts by mass or more polyisocyanate ensures that the urethane linkages are many enough that the rubber plate will have an appropriate hardness as a result of hard-segment growth. The use of 40 parts by mass or less polyisocyanate prevents the hard segment from being too large, thereby ensuring that the scrubbing member is stretchable and therefore resistant to chipping.

Crosslinking Agent

Examples of crosslinking agents include diols (bifunctional), triols (trifunctional), and tetraols (tetrafunctional), and they may be used in combination. Amine compounds may also be used as crosslinking agents. Preferably, the polyurethane has been crosslinked using a crosslinking agent that has three or more functional groups. Examples of trifunctional crosslinking agents include trimethylolpropane, glycerol, and triisopropanolamine.

The amount of the crosslinking agent(s) per 100 parts by mass of resins having an isocyanate-reactive group may be 2 parts by mass of less. The use of 2 parts by mass or less crosslinking agent(s) ensures that the resulting chemical crosslinks do not restrict molecular movement. The hard segment, derived from urethane linkages, therefore grows well when aged, and this helps give the rubber plate an appropriate hardness.

Shaping of the Rubber Plate

A rubber plate that contains polyurethane, an example of a rubber, can be produced by an ordinary production process for polyurethane, such as the prepolymer method or one-shot method. The prepolymer method gives a polyurethane superior in strength and wear resistance, but the rubber plate is not limited by the process used to produce it.

To prepare the polyurethane, the aforementioned polyol is blended and mixed with other materials such as a polyisocyanate compound and a crosslinking agent. The prepared composition for the formation of the rubber plate is shaped into a sheet, for example by centrifugation or extrusion. Machine cutting, for example, of the resulting sheet gives the rubber plate.

Physical Characteristics

If the rubber contained in the rubber plate is polyurethane, the weight average molecular weight of the polyurethane may be 1000 or more and 4000 or less, preferably 1500 or more and 3500 or less.

The cleaning blade may have a JIS-A hardness ($H_{BLD}$) of 60° or more and 95° or less, preferably 65° or more and 90° or less, more preferably 70° or more and 85° or less at least in the portion where it contacts the electrophotographic photoreceptor.

As mentioned above, a hardness of the cleaning blade in these ranges, or a cleaning blade having a relatively high hardness in the image forming apparatus, tends to result in a higher incidence of a streak-shaped image defect caused by filming and that caused by passed residual toner. In this exemplary embodiment, the use of a toner according to this exemplary embodiment reduces both the streak-shaped image defect caused by filming and that caused by passed residual toner even if the image forming apparatus includes an electrophotographic photoreceptor that has a high-hardness cleaning blade.

The JIS-A hardness is the value measured using a type-A durometer as specified in JIS K 7215 (1986) in accordance with the hardness testing method set forth in JIS K 7311 (1995).

The contact portion of a cleaning blade where it contacts the electrophotographic photoreceptor includes both of the following two: the portion where the cleaning blade contacts the electrophotographic photoreceptor while the electrophotographic photoreceptor is not rotating, and the portion where the cleaning blade contacts the electrophotographic photoreceptor while the electrophotographic photoreceptor is rotating.

To make the JIS-A hardness of the contact portion of the cleaning blade 60 or more and 75 or less, the manufacturer may take several approaches, including selecting an appropriate combination of hard-segment and soft-segment materials; adjusting the proportions of (mixing ratio between) the hard-segment and soft-segment materials; or customizing the conditions under which the composition for the formation of the rubber plate (composition for cleaning blade shaping) is cured (duration of aging, aging temperature, etc.).

The ratio of the hardness of the cleaning blade ($H_{BLD}$) to that of the surface-protecting layer ($H_{OCL}$) ($H_{BLD}/H_{OCL}$) may be 0.8 or less, preferably 0.7 or less, more preferably 0.6 or less in view of further reduction of both the streak-shaped image defect caused by filming and that caused by passed residual toner.

Static Eliminator

The eraser 24 is located, for example, downstream of the cleaning device 22 in the direction of rotation of the electrophotographic photoreceptor 12. After the transfer of the toner image, the eraser 24 removes static electricity from the surface of the electrophotographic photoreceptor 12 by irradiating the surface with light. To be more specific, the eraser 24 in an exemplary configuration may be electrically coupled to a control device 36 that is part of the image forming apparatus 10. Under the control of the control device 36, the eraser 24 removes static electricity from the surface of the electrophotographic photoreceptor 12 by irradiating the entire surface (specifically the entire image forming region, for example) of the electrophotographic photoreceptor 12.

The eraser 24 may be, for example, a device that has a tungsten lamp, which emits white light, a light-emitting diode (LED) that emits red light, or any other light source.

Fixing Device

The fixing device 26 is located, for example, downstream of the transfer region 32A in the direction in which the recording medium 30A is transported along the transport route 34. The fixing device 26 has a fixing member 26A and a pressure member 26B in contact with the fixing member 26A and fixes the toner image transferred to the recording medium 30A at the point of contact between the fixing member 26A and the pressure member 26B. To be more specific, the fixing device 26 in an exemplary configuration may be electrically coupled to a control device 36 that is part of the image forming apparatus 10. Under the control of the control device 36, the fixing device 26 applies heat and pressure to the toner image transferred to the recording medium 30A, thereby fixing the toner image on the recording medium 30A.

The fixing device 26 may be, for example, a fuser known in itself, such as a heat-roll fuser or an belt fuser.

To be more specific, the fixing device 26 in an exemplary configuration may be a known fixing device that includes a fixing roller or fixing belt as the fixing member 26A and a pressure roller or pressure belt as the pressure member 26B.

The recording medium 30A has been transported along the transport route 34, passed through the region where the electrophotographic photoreceptor 12 and the transfer member 20 face each other (transfer region 32A), and thereby received the toner image transferred thereto. The recording medium 30A is then further transported along the transport route 34, for example by a transport member not illustrated, to the point where the fixing device 26 sits. And the toner image on the recording medium 30A is fixed.

After an image is formed thereon through the fixation of the toner image, the recording medium 30A is ejected from the image forming apparatus 10 by multiple transport members not illustrated. The electrophotographic photoreceptor 12 from which static electricity has been removed by the eraser 24 is charged again to a charging potential by the charging device 15.

Operation of the Image Forming Apparatus

The following describes an example of operations of an image forming apparatus 10 according to this exemplary embodiment. It should be noted that the operations of the image forming apparatus 10 are conducted by a control program that runs on the control device 36.

The image forming apparatus 10 forms an image as follows.

First, the surface of the electrophotographic photoreceptor 12 is charged by the charging device 15. The electrostatic-charge-image-forming device 16 irradiates the charged surface of the electrophotographic photoreceptor 12 with light on the basis of image information, thereby forming an electrostatic charge image on the electrophotographic photoreceptor 12 in accordance with the image information. At the developing device 18, the electrostatic charge image formed on the surface of the electrophotographic photoreceptor 12 is developed with a developer that includes a specific toner. In this way, a toner image is formed on the surface of the electrophotographic photoreceptor 12.

At the transfer device 31, the toner image formed on the surface of the electrophotographic photoreceptor 12 is transferred to a recording medium 30A. The toner image transferred to the recording medium 30A is fixed by the fixing device 26.

The electrophotographic photoreceptor 12 from which the toner image has been transferred has its surface cleaned by the cleaning blade 220 of the cleaning device 22, and then static electricity is removed therefrom by the eraser 24.

Electrostatic-Charge-Image Developer

An electrostatic-charge-image developer according to this exemplary embodiment includes at least a specific toner. The electrostatic-charge-image developer according to this exemplary embodiment may be a one-component developer, which is substantially a specific toner, or may be a two-component developer, which is a mixture of a specific toner and a carrier.

Toner for Electrostatic Charge Image Development

A toner for electrostatic charge image development (specific toner) according to this exemplary embodiment includes toner particles and optionally external additives.

Temperature and Viscosity Parameters of the Specific Toner

The specific toner satisfies the following relations:

$$(\ln\eta(T1)-\ln\eta(T2))/(T1-T2)\leq-0.14;$$

$$(\ln\eta(T2)-\ln\eta(T3))/(T2-T3)\leq-0.15;\text{ and}$$

$$(\ln\eta(T1)-\ln\eta(T2))/(T1-T2)<(\ln\eta(T2)-\ln\eta(T3))/(T2-T3),$$

where η(T1) represents the viscosity of the specific toner at 60° C., η(T2) represents the viscosity of the specific toner at 90° C., and η(T3) represents the viscosity of the specific toner at 130° C.

The expression "lnη(T1)" herein represents the natural logarithm of the viscosity η of the toner at T1=60° C. It may be expressed as ln(η(T1)).

Viscosity values of a specific toner herein have a unit of Pa·s unless stated otherwise. These viscosity values at certain temperatures of a specific toner in this exemplary embodiment are measurements obtained as follows.

Loss moduli of a specific toner are determined by performing a temperature raising test using a plate rheometer (RDA2 RHIOS system ver. 4.3, produced by Rheometric Scientific Ld.). In the test, an approximately 0.3 g sample of the toner placed between 8 mm parallel plates is heated from approximately 30° C. to approximately 150° C. at a temperature raising rate of 1° C./min under a 20% or less distortion at a frequency of 1 Hz.

The $(\ln\eta(T1)-\ln\eta(T2))/(T1-T2)$ as a parameter of the specific toner is −0.14 or less. It may be −0.16 or less, preferably −0.30 or more and −0.18 or less, more preferably −0.25 or more and −0.20 or less in view of further reduction of both the streak-shaped image defect caused by filming and that caused by passed residual toner.

The $(\ln\eta(T2)-\ln\eta(T3))/(T2-T3)$ as a parameter of the specific toner is −0.15 or more. It may be more than −0.14, preferably −0.13 or more, more preferably −0.12 or more and −0.03 or less, in particular −0.11 or more and −0.05 or less in view of further reduction of both the streak-shaped image defect caused by filming and that caused by passed residual toner.

Moreover, the $(\ln\eta(T2)-\ln\eta(T3))/(T2-T3)$ of the specific toner is larger than the $(\ln\eta(T1)-\ln\eta(T2))/(T1-T2)$ of the specific toner. The $\{(\ln\eta(T2)-\ln\eta(T3))/(T2-T3)\}-\{(\ln\eta(T1)-\ln\eta(T2))/(T1-T2)\}$ may be 0.01 or more, preferably 0.05 or more and 0.5 or less, in particular 0.08 or more and 0.2 or less in view of further reduction of both the streak-shaped image defect caused by filming and that caused by passed residual toner.

The specific toner, moreover, may have a $(\ln\eta(T0)-\ln\eta(T1))/(T0-T1)$, where $\eta(T0)$ represents the viscosity $\eta$ of the toner at T0=40° C., of −0.12 or more and greater than the $(\ln\eta(T1)-\ln\eta(T2))/(T1-T2)$.

The specific toner becomes more effective in reducing both the streak-shaped image defect caused by filming and that caused by passed residual toner when it has a $(\ln\eta(T0)-\ln\eta(T1))/(T0-T1)$ of −0.12 or more. The $(\ln\eta(T0)-\ln\eta(T1))/(T0-T1)$ may be −0.05 or less, in particular −0.11 or more and −0.06 or less.

The specific toner, moreover, becomes more effective in reducing both the streak-shaped image defect caused by filming and that caused by passed residual toner when its $(\ln\eta(T0)-\ln\eta(T1))/(T0-T1)$ is greater than its $(\ln\eta(T1)-\ln\eta(T2))/(T1-T2)$. The $\{(\ln\eta(T0)-\ln\eta(T1))/(T0-T1)\}-\{(\ln\eta(T1)-\ln\eta(T2))/(T1-T2)\}$ may be 0.01 or more, preferably 0.05 or more and 0.5 or less, in particular 0.08 or more and 0.2 or less.

It should be noted that these temperature and viscosity parameters $(\ln\eta(T1)-\ln\eta(T2))/(T1-T2)$, $(\ln\eta(T2)-\ln\eta(T3))/(T2-T3)$, and $(\ln\eta(T0)-\ln\eta(T1))/(T0-T1)$ of the toner may be controlled to be within the above ranges by any method. An example is to adjust the molecular weight of the binder resin in the toner particles, more specifically the molecular weights and percentages of the low molecular weight and high molecular weight components of the binder resin. If the toner particles are produced by the undermentioned aggregation and coalescence method, these parameters may alternatively be controlled by adjusting the degree of aggregation, for example by changing the amount of flocculant.

The $\eta(T0)$, $\eta(T1)$, $\eta(T2)$, and $\eta(T3)$ of the specific toner, which are the viscosity values of the toner at T0=40° C., T1=60° C., T2=90° C., and T3=130° C., respectively, may be respectively within the following ranges in view of further reduction of both the streak-shaped image defect caused by filming and that caused by passed residual toner.

$\eta(T0)$: $1.0\times10^7$ or more and $1.0\times10^9$ or less (preferably $2.0\times10^7$ or more and $5.0\times10^8$ or less)

$\eta(T1)$: $1.0\times10^5$ or more and $1.0\times10^8$ or less (preferably $1.0\times10^6$ or more and $5.0\times10^7$ or less)

$\eta(T2)$: $1.0\times10^3$ or more and $1.0\times10^5$ or less (preferably $5.0\times10^3$ or more and $5.0\times10^4$ or less)

$\eta(T3)$: $1.0\times10^2$ or more and $1.0\times10^4$ or less (preferably $1.0\times10^2$ or more and $5.0\times10^3$ or less)

Highest-Endothermic-Peak Temperature of the Toner

The highest-endothermic-peak temperature of the specific toner may be 70° C. or more and 100° C. or less, preferably 75° C. or more and 95° C. or less, in particular 83° C. or more and 93° C. or less.

Here, the highest-endothermic-peak temperature of a specific toner is defined as the temperature at which the toner's differential scanning calorimetry (DSC) endothermic curve measured over the range of at least −30° C. to 150° C. has its highest peak.

A method that may be used to measure the highest-endothermic-peak temperature of a specific toner is as follows.

The measuring instrument is PerkinElmer DCS-7 differential scanning calorimeter. The temperature calibration of the colorimeter's detector is based on the melting point of indium and zinc, and the enthalpy calibration is based on the melting enthalpy of indium. An aluminum pan with a sample therein and a control empty pan are heated from room temperature to 150° C. at a temperature raising rate of 10° C./min, cooled from 150° C. to −30° C. at a rate of 10° C./min, and then heated from −30° C. to 150° C. at a rate of 10° C./min. The temperature at which the largest endothermic peak is observed in the second run of heating is the highest-endothermic-peak temperature.

Infrared Absorption Spectrum of the Toner Particles

If the specific toner contains the undermentioned amorphous polyester resin as a binder resin, it may be that in an infrared absorption (IR) spectrum of the toner particles, the ratio of the absorbance at a wavenumber of 1,500 $cm^{-1}$ to that at 720 $cm^{-1}$ (absorbance at 1,500 $cm^{-1}$/absorbance at 720 $cm^{-1}$) is 0.6 or less, and, at the same time, the ratio of the absorbance at a wavenumber of 820 $cm^{-1}$ to that at 720 $cm^{-1}$ (absorbance at 820 $cm^{-1}$/absorbance at 720 $cm^{-1}$) is 0.4 or less in view of further reduction of both the streak-shaped image defect caused by filming and that caused by escaped toner residue. Preferably, in an IR spectrum of the toner particles, the ratio of the absorbance at a wavenumber of 1,500 $cm^{-1}$ to that at 720 $cm^{-1}$ is 0.4 or less with the ratio of the absorbance at a wavenumber of 820 $cm^{-1}$ to that at 720 $cm^{-1}$ being 0.2 or less. It is more preferred that in an IR spectrum of the toner particles, the ratio of the absorbance at a wavenumber of 1,500 $cm^{-1}$ to that at 720 $cm^{-1}$ be 0.2 or more and 0.4 or less with the ratio of the absorbance at a wavenumber of 820 $cm^{-1}$ to that at 720 $cm^{-1}$ being 0.05 or more and 0.2 or less.

These IR absorbance values at certain wavenumbers in this exemplary embodiment are measured as follows. First, the toner particles of interest (after the removal of any external additive from the toner) are made into a sample for measurement by KBr tableting. This sample for measurement is analyzed using an IR spectrophotometer (JASCO FT-IR-410) at wavenumbers between 500 $cm^{-1}$ and 4,000 $cm^{-1}$ under the conditions of 300 scans and a resolution of 4 $cm^{-1}$. Then baseline correction is performed, for example in an offset, a spectral portion with no absorption, to determine the absorbance values at the wavenumbers.

The specific toner, moreover, may be such that in an IR spectrum of the toner particles, the ratio of the absorbance at a wavenumber of 1,500 $cm^{-1}$ to that at 720 $cm^{-1}$ may be 0.6 or less, preferably 0.4 or less, more preferably 0.2 or more and 0.4 or less, in particular 0.3 or more and 0.4 or less in view of further reduction of both the streak-shaped image defect caused by filming and that caused by escaped toner residue.

Likewise, the specific toner may be such that in an IR spectrum of the toner particles, the ratio of the absorbance at a wavenumber of 820 $cm^{-1}$ to that at 720 $cm^{-1}$ may be 0.4 or less, preferably 0.2 or less, more preferably 0.05 or more and 0.2 or less, in particular 0.08 or more and 0.2 or less in view of further reduction of both the streak-shaped image defect caused by filming and that caused by escaped toner residue.

Toner Particles

The toner particles contain, for example, a binder resin and optionally a coloring agent, a release agent, and/or other additives. Preferably, the toner particles contain a binder resin and a release agent.

In this exemplary embodiment, the toner particles may be of any kind. Examples include particles such as of a yellow, magenta, cyan, or black toner and even include white toner particles, transparent toner particles, and glossy toner particles.

Binder Resin

The binder resin may be, for example, a vinyl resin. The vinyl resin may be a homopolymer of a monomer or a copolymer of two or more monomers, and examples of monomers include styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Alternatively, the binder resin may be, for example, a non-vinyl resin, such as an epoxy resin, polyester resin, polyurethane resin, polyamide resin, cellulose resin, polyether resin, or modified rosin, a mixture of any of these resins and the aforementioned vinyl resin, or a graft copolymer obtained by copolymerizing a vinyl monomer in the presence of any of these non-vinyl resins.

One of these binder resins may be used alone, or two or more may be used in combination.

The binder resin(s) may include at least one selected from the group consisting of a styrene-acrylic resin and an amorphous polyester resin, preferably one of a styrene-acrylic resin and an amorphous polyester resin, in view of further reduction of both the streak-shaped image defect caused by filming and that caused by passed residual toner. It is more preferred that the percentage of the styrene-acrylic resin or amorphous polyester resin to the total mass of binder resins in the toner be 50% by mass or more, in particular 80% by mass or more.

A styrene-acrylic resin gives the specific toner strength and stability during storage if contained as a binder resin.

An amorphous polyester resin ensures fixation at low temperatures if contained in the specific toner as a binder resin.

The amorphous polyester resin may be one that has no bisphenol structure in view of further reduction of both the streak-shaped image defect caused by filming and that caused by escaped toner residue and also of fixation.

(1) Styrene-Acrylic Resin

An example of a binder resin is a styrene-acrylic resin.

A styrene-acrylic resin is a copolymer of at least a styrene monomer (monomer having the styrene structure) and a (meth)acrylic monomer (monomer having a (meth)acrylic group, preferably a (meth)acryloxy group). Copolymers of, for example, a styrene monomer and any of the aforementioned (meth)acrylate monomers are also examples of styrene-acrylic resins.

It is to be noted that the acrylic resin segment of a styrene-acrylic resin is a moiety resulting from the polymerization of an acrylic monomer, a methacrylic monomer, or both. The expression "(meth)acrylic" is intended to represent both "acrylic" and "methacrylic."

Specific examples of styrene monomers include styrene, alkylated styrenes (e.g., α-methylstyrene, 2-methylstyrene, 3-methylstyrene, 4-methylstyrene, 2-ethylstyrene, 3-ethylstyrene, and 4-ethylstyrene), halogenated styrenes (e.g., 2-chlorostyrene, 3-chlorostyrene, and 4-chlorostyrene), and vinylnaphthalene. One styrene monomer may be used alone, or two or more may be used in combination.

Of these styrene monomers, styrene is preferred by the characteristic of its high reactivity, ready availability, and ease of control of the reaction involving it.

Specific examples of (meth)acrylic monomers include (meth)acrylic acid and (meth)acrylates. Examples of (meth) acrylates include alkyl (meth)acrylates (e.g., methyl (meth) acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, and t-butylcyclohexyl (meth)acrylate), aryl (meth)acrylates (e.g., phenyl (meth) acrylate, biphenyl (meth)acrylate, diphenylethyl (meth) acrylate, t-butylphenyl (meth)acrylate, and terphenyl (meth) acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamides. One (meth)acrylic monomer may be used alone, or two or more may be used in combination.

Of these (meth)acrylates as (meth)acrylic monomers, those (meth)acrylates that have a C2-14 (preferably C2-10, more preferably C3-8) alkyl group are preferred because they provide better fixation of the toner.

n-Butyl (meth)acrylate is particularly preferred. In particular, n-butyl acrylate is preferred.

The copolymer may contain styrene monomers and (meth)acrylic monomers in any ratio (by mass, styrene monomers/(meth)acrylic monomers). For example, the ratio of the two types of monomers in the copolymer may be between 85/15 to 70/30.

The styrene-acrylic resin may have a crosslink structure in view of further reduction of both the streak-shaped image defect caused by filming and that caused by passed residual toner. An example of a crosslinked styrene-acrylic resin is a copolymer of at least a styrene monomer, a (meth)acrylic monomer, and a crosslinking monomer.

The crosslinking monomer may be, for example, a crosslinking agent that has two or more functional groups.

Examples of bifunctional crosslinking agents include divinyl benzene, divinyl naphthalene, di(meth)acrylate compounds (e.g., diethylene glycol di(meth)acrylate, methylene bis(meth)acrylamide, decanediol diacrylate, and glycidyl (meth) acrylate), polyester-forming di(meth)acrylates, and 2-([1'-methylpropylideneamino]carboxyamino)ethyl methacrylate.

Examples of multifunctional crosslinking agents include tri(meth)acrylate compounds (e.g., pentaerythritol tri(meth) acrylate, trimethylolethane tri(meth)acrylate, and trimethylolpropane tri(meth)acrylate), tetra(meth)acrylate compounds (e.g., pentaerythritol tetra(meth)acrylate and oligoester (meth)acrylates), 2,2-bis(4-methacryloxy, polyethoxyphenyl)propane, diallyl phthalate, triallyl cyanurate, triallyl isocyanurate, triallyl trimellitate, and diaryl chlorendate.

Preferably, the crosslinking monomer is a (meth)acrylate compound that has two or more functional groups in view of further reduction of both the streak-shaped image defect caused by filming and that caused by passed residual toner and also of fixation. It is more preferred that the crosslinking agent be a bifunctional (meth)acrylate compound, even more preferably a bifunctional (meth)acrylate that has a C6-20 alkylene group, in particular a bifunctional (meth) acrylate that has a linear C6-20 alkylene group.

The copolymer may contain crosslinking monomers in any ratio to all monomers (by mass, crosslinking monomers/all monomers). For example, the ratio of crosslinking monomers to all monomers may be between 2/1,000 and 20/1,000.

The glass transition temperature (Tg) of the styrene-acrylic resin may be 40° C. or more and 75° C. or less, preferably 50° C. or more and 65° C. or less, in view of fixation.

This glass transition temperature is that determined from the resin's DSC curve, which is obtained by differential scanning calorimetry (DSC). More specifically, this glass transition temperature is the resin's "extrapolated initial temperature of glass transition" as in the methods for determining glass transition temperatures set forth in JIS K 7121-1987 "Testing Methods for Transition Temperatures of Plastics."

The weight average molecular weight of the styrene-acrylic resin may be 5,000 or more and 200,000 or less, preferably 10,000 or more and 100,000 or less, in particular 20,000 or more and 80,000 or less, in view of stability during storage.

The production of the styrene-acrylic resin may be by any method. A wide variety of polymerization techniques (solution polymerization, precipitation polymerization, suspension polymerization, bulk polymerization, emulsion polymerization, etc.) may be used, and the polymerization reactions may be done by any process (batch, semicontinuous, continuous, etc.).

(2) Polyester Resin

A polyester resin is also an example of a binder resin. The polyester resin may be, for example, a known amorphous polyester resin. It is also possible to use a crystalline polyester resin in combination with an amorphous polyester resin. In that case, the percentage of the crystalline polyester resin may be, for example, 2% by mass or more and 40% by mass or less (preferably 2% by mass or more and 20% by mass or less) with respect to all binder resins.

If a resin is "crystalline" herein, it means that the resin exhibits not stepwise changes in heat absorption but a clear endothermic peak when analyzed by differential scanning calorimetry (DSC). To be more specific, being "crystalline" herein means that the half width of the endothermic peak as measured at a temperature elevation rate of 10 (° C./min) is 10° C. or narrower.

Meanwhile, if a resin is "amorphous" herein, it means that in DSC, the above half width is broader than 10° C., the resin exhibits stepwise changes in heat absorption, or the endothermic peak is not clear.

Amorphous Polyester Resin

The amorphous polyester resin may be, for example, a polycondensate of a polycarboxylic acid and a polyhydric alcohol. The amorphous polyester resin may be a commercially available one or may be a synthesized one.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides or lower-alkyl (e.g., C1-5 alkyl) esters of these acids. Of these polycarboxylic acids, aromatic dicarboxylic acids, for example, are preferred.

For polycarboxylic acids, it is also possible to use a dicarboxylic acid in combination with a crosslinked or branched carboxylic acid that has three or more carboxylic groups. Examples of carboxylic acids that have three or more carboxylic groups include trimellitic acid, pyromellitic acid, and anhydrides or lower-alkyl (e.g., C1-5 alkyl) esters of these acids.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these polyhydric alcohols, aromatic diols and alicyclic diols, for example, are preferred, and aromatic diols are more preferred.

For polyhydric alcohols, it is also possible to use a diol in combination with a crosslinked or branched polyhydric alcohol that has three or more hydroxyl groups. Examples of polyhydric alcohols that have three or more hydroxyl groups include glycerol, trimethylolpropane, and pentaerythritol.

One polyhydric alcohol may be used alone, or two or more may be used in combination.

The glass transition temperature (Tg) of the amorphous polyester resin may be 50° C. or more and 80° C. or less, preferably 50° C. or more and 65° C. or less.

This glass transition temperature is that determined from the resin's DSC curve, which is obtained by differential scanning calorimetry (DSC). More specifically, this glass transition temperature is the resin's "extrapolated initial temperature of glass transition" as in the methods for determining glass transition temperatures set forth in JIS K 7121-1987 "Testing Methods for Transition Temperatures of Plastics."

The weight average molecular weight (Mw) of the amorphous polyester resin may be 5000 or more and 1000000 or less, preferably 7000 or more and 500000 or less.

The number average molecular weight (Mn) of the amorphous polyester resin may be 2000 or more and 100000 or less.

The molecular weight distribution Mw/Mn of the amorphous polyester resin may be 1.5 or more and 100 or less, preferably 2 or more and 60 or less.

These weight and number average molecular weights are those measured by gel permeation chromatography (GPC). By GPC, the resin is analyzed using HLC-8120GPC, a GPC system from Tosoh, and Tosoh TSKgel SuperHM-M column (15 cm) with the eluate tetrahydrofuran (THF). Comparing the measured data with a molecular-weight calibration curve prepared using monodisperse polystyrene standards gives the weight- and number-average molecular weights.

The production of the amorphous polyester resin may be by a known method. To be more specific, the amorphous polyester resin may be obtained by, for example, polymerizing starting monomers by condensation polymerization at a temperature of 180° C. or more and 230° C. or less, optionally under reduced pressure so that the water and alcohol as condensation by-products will be removed.

If the starting monomers do not dissolve or are not compatible with each other at the reaction temperature, a high-boiling-point solvent as a solubilizer may be added to help them dissolve. In that case, the solubilizer is removed by distillation during the polycondensation. If the copolymerization involves a monomer that is incompatible with the reaction system, this monomer may be first condensed with an acid or alcohol planned to participate in the polycondensation and then subjected to polycondensation with the remaining ingredient(s).

Crystalline Polyester Resin

The crystalline polyester resin may be, for example, a polycondensate of a polycarboxylic acid and a polyhydric alcohol. The crystalline polyester resin may be a commercially available one or may be a synthesized one.

The crystalline polyester resin may be a polycondensate made using polymerizable monomers having a linear aliphatic structure, rather than an aromatic structure. This helps the resin form its crystal structure.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides or lower-alkyl (e.g., C1-5 alkyl) esters of these acids.

For polycarboxylic acids, it is also possible to use a dicarboxylic acid in combination with a crosslinked or branched carboxylic acid that has three or more carboxylic groups. Examples of carboxylic acids that have three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides or lower-alkyl (e.g., C1-5 alkyl) esters of these acids.

Moreover, it is possible to use any of the above carboxylic acids with a dicarboxylic acid that has a sulfonic acid group and/or a dicarboxylic acid that has an ethylenic double bond.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these aliphatic diols, 1,8-octanediol, 1,9-nonanediol, and 1,10-decanediol are preferred.

For polyhydric alcohols, it is also possible to use a diol in combination with a crosslinked or branched alcohol that has three or more hydroxyl groups. Examples of alcohols that have three or more hydroxyl groups include glycerol, trimethylolethane, trimethylolpropane, and pentaerythritol.

One polyhydric alcohol may be used alone, or two or more may be used in combination.

For polyhydric alcohols, the percentage of aliphatic diols may be 80 mol % or more, preferably 90 mol % or more.

The melting temperature of the crystalline polyester resin may be 50° C. or more and 100° C. or less, preferably 55° C. or more and 90° C. or less, more preferably 60° C. or more and 85° C. or less.

This melting temperature is the resin's "peak melting temperature" as in the methods for determining melting temperatures set forth in JIS K7121-1987 "Testing Methods for Transition Temperatures of Plastics" and is determined from the resin's DSC curve, which is obtained by differential scanning calorimetry (DSC).

The weight average molecular weight (Mw) of the crystalline polyester resin may be 6,000 or more and 35,000 or less.

The production of the crystalline polyester resin may be by a known method. For example, the crystalline polyester resin may be produced in the same way as the amorphous polyester resin.

The amount of the binder resin(s) may be, for example, 40% by mass or more and 95% by mass or less, preferably 50% by mass or more and 90% by mass or less, more preferably 60% by mass or more and 85% by mass or less of the total mass of the toner particles.

If the toner particles are white toner particles, the percentage of the binder resin(s) may be 30% by mass or more and 85% by mass or less, preferably 40% by mass or more and 60% by mass or less of the total mass of the white toner particles.

Coloring Agent

Examples of coloring agents include pigments, such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, Calco oil blue, methylene blue chloride, phthalocyanine blue, pigment blue, phthalocyanine green, malachite green oxalate, titanium oxide, zinc oxide, calcium carbonate, basic lead carbonate, a zinc sulfide-barium sulfate mixture, zinc sulfide, silicon dioxide, and aluminum oxide, and dyes, such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole dyes.

If the toner particles are white toner particles, the coloring agent is a white pigment.

The white pigment may be titanium oxide or zinc oxide, preferably titanium oxide.

If the toner particles are white toner particles, the amount of the white pigment may be 15% by mass or more and 70% by mass or less, preferably 20% by mass or more and 60% by mass or less, of the total mass of the white toner particles.

One coloring agent may be used alone, or two or more may be used in combination.

The coloring agent(s) may optionally be surface-treated one(s) and may be used in combination with a dispersant. Moreover, multiple coloring agents may be used in combination.

The amount of the coloring agent(s) may be 1% by mass or more and 30% by mass or less, preferably 3% by mass or more and 15% by mass or less of the total mass of the toner particles.

Release Agent

Examples of release agents include, but are not limited to, hydrocarbon waxes; natural waxes, such as carnauba wax, rice wax, and candelilla wax; synthesized or mineral/petroleum waxes, such as montan wax; and ester waxes, such as fatty acid esters and montanates.

The melting temperature of the release agent may be 50° C. or more and 110° C. or less, preferably 70° C. or more and 100° C. or less, more preferably 75° C. or more and 95° C. or less, in particular 83° C. or more and 93° C. or less, in view of further reduction of both the streak-shaped image defect caused by filming and that caused by passed residual toner and also of fixation.

This melting temperature is the agent's "peak melting temperature" as in the methods for determining melting temperatures set forth in JIS K 7121-1987 "Testing Methods for Transition Temperatures of Plastics" and is determined from the agent's DSC curve, which is obtained by differential scanning calorimetry (DSC).

The toner particles in the specific toner may satisfy the relation $1.0<a/b<8.0$, where a and b are the numbers of the release agent with an aspect ratio of 5 or more and smaller than 5, respectively, in the toner particles, in view of further reduction of both the streak-shaped image defect caused by filming and that caused by passed residual toner and also of fixation. Preferably, the toner particles satisfy the relation $2.0<a/b<7.0$, in particular $3.0<a/b<6.0$.

The toner particles in the specific toner, moreover, may satisfy the relation $1.0<c/d<4.0$, where c and d are the areas of the release agent with an aspect ratio of 5 or more and smaller than 5, respectively, in the toner particles, in view of further reduction of both the streak-shaped image defect caused by filming and that caused by passed residual toner and also of fixation. Preferably, the toner particles satisfy the relation $1.5<c/d<3.5$, in particular $2.0<c/d<3.0$.

The measurement of the aspect ratio of the release agent in the toner is as follows.

The toner is mixed into an epoxy resin, and the epoxy resin is solidified. The resulting solid is sliced using an ultramicrotome (ULTRACUT UCT, produced by Leica-Microsystems GmgH) to give a thin section with a thickness of 80 nm or more and 130 nm or less as a sample. The thin-section sample is stained with ruthenium tetroxide for 3 hours in a desiccator at 30° C. The stained thin-section sample is imaged by scanning electron microscopy (SEM) using an ultrahigh-resolution field-emission scanning electron microscope (FE-SEM) (e.g., S-4800 from Hitachi High-Technologies Corp.). Release agents are generally stained more heavily than binder resins with ruthenium tetroxide, so the release agent is identified by shades of color caused by the degree of staining. If it is difficult to distinguish between the shades, for example because of the condition of the sample, the duration of staining is adjusted. Size may also provide the basis for identifying the release agent. In a cross-section of a toner particle, the coloring-agent domain is usually smaller than the release-agent domain.

The SEM image includes cross-sections of toner particles of various sizes. From these cross-sections, those having a diameter of 85% or more of the volume-average diameter of the toner particles are selected, and 100 of them are randomly selected and observed. Here, the diameter of a cross-section of a toner particle is defined as the longest distance between any two points on the outline of the cross-section (so-called major axis).

Each of the 100 cross-sections of toner particles selected in the SEM image is analyzed using image analysis software (WINROOF produced by Mitani Corp.) under the condition of 0.010000 μm/pixel. The image analysis visualizes the cross-sections of toner particles by displaying the embedding epoxy resin and the binder resin(s) in the toner particles with different levels of brightness (with a contrast therebetween). On the visualized image, the major axis and the aforementioned ratio (major axis/minor axis) and area of the release-agent domains in the toner particles can be determined.

The adjustment of the aspect ratio of the release agent in the toner may be done by several methods. For example, the toner may be maintained near the freezing point of the release agent for a certain period of time during cooling so that crystal growth will take place, or two or more release agents with different melting temperatures may be used to accelerate crystal growth during cooling.

The amount of the release agent(s) may be, for example, 1% by mass or more and 20% by mass or less, preferably 5% by mass or more and 15% by mass or less of the total mass of the toner particles.

Other Additives

Examples of other additives include magnetic substances, charge control agents, inorganic powders, and other known additives. These additives, if used, are contained in the toner particles as internal additives.

Characteristics and Other Details of the Toner Particles

The toner particles may be single layer toner particles or may be so-called core shell toner particles, i.e., toner particles formed by a core section (core particle) and a coating layer that covers the core section (shell layer).

The core shell toner particles may be formed by, for example, a core section that includes a binder resin and optionally additives, such as a coloring agent and/or a release agent, and a coating layer that includes a binder resin.

The volume average diameter (D50v) of the toner particles may be 2 μm or more and 10 μm or less, preferably 4 μm or more and 8 μm or less.

The volume average diameter of the toner particles is that measured using a COULTER MULTISIZER II (Beckman Coulter) and an ISOTON-II electrolyte (Beckman Coulter).

The measurement is as follows. A sample for measurement weighing 0.5 mg or more and 50 mg or less is added to 2 ml of a 5% by mass aqueous solution of a surfactant (e.g., a sodium alkylbenzene sulfonate) as a dispersant. The resulting dispersion is added to 100 ml or more and 150 ml or less of the electrolyte.

With the sample suspended therein, the electrolyte is sonicated for 1 minute using a sonicator. The resulting dispersion is analyzed using COULTER MULTISIZER II with an aperture size of 100 μm to determine the particle size distribution of those particles that are 2 μm or more and 60 μm or less across. The number of particles sampled is 50000.

The determined particle size distribution is divided into segments by particle size (channels), and the cumulative distribution of volume is plotted starting from the smallest diameter. The particle diameter at which the cumulative volume is 50% is defined as the volume average diameter D50v.

The toner particles may have any average circularity. In view of easier cleaning of the toner off the image carrier, however, the average circularity may be 0.91 or more and 0.98 or less, preferably 0.94 or more and 0.98 or less, more preferably 0.95 or more and 0.97 or less.

The average circularity of the toner particles is given by (circumference of the equivalent circle)/(circumference) [(circumference of circles having the same projected area as the particle images)/(circumference of the projected images of the particles)]. A specific way of determining it is as follows.

First, a number of the toner particles of interest are sampled by aspiration. By photographing the resulting flat stream with a flash, the figures of the particles therein are captured in a still image. Then the particle images are analyzed using a flow particle-image analyzer (FPIA-3000, produced by Sysmex corp.) to determine the average circularity. The number of particles sampled in the determination of the average circularity is 3500.

If the toner contains an external additive, the toner (developer) of interest is dispersed in water containing a surfactant and sonicated. This gives toner particles isolated from the external additive.

The average circularity of the toner particles may be controlled by several methods. For example, if the toner particles are produced by aggregation and coalescence, the average circularity may be controlled by adjusting the speed of stirring of the liquid dispersion, temperature of the liquid dispersion, or time for which the liquid dispersion is maintained during fusion and coalescence.

External Additives

An example of an external additive is inorganic particles. Examples of such inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particles as an external additive may be hydrophobic as a result of treatment. An example of a hydrophobic treatment is to immerse the inorganic particles in an agent for hydrophobic treatment. Any kind of agent may be used, but examples include silane coupling agents, silicone oil, titanate coupling agents, and aluminum coupling agents. One of these may be used alone, or two or more may be used in combination.

The amount of the agent(s) for hydrophobic treatment is usually 1 part by mass or more and 10 parts by mass or less, for example, per 100 parts by mass of the inorganic particles.

Substances such as resin particles (particles of polystyrene, polymethyl methacrylate (PMMA), melamine resins, etc.) and active cleaning agents (e.g., metal salts of higher fatty acids, typically zinc stearate, and particles of fluoropolymers) are also examples of external additives.

The amount of external additives may be, for example, 0.01% by mass or more and 10% by mass or less, preferably 0.01% by mass or more and 6% by mass or less, of the toner particles.

Production of the Toner

Next is described a method for producing the specific toner.

The specific toner is obtained by producing toner particles and then adding external additive(s) to the toner particles.

The production of the toner particles may be by a dry process (e.g., kneading and milling) or a wet process (e.g., aggregation and coalescence, suspension polymerization, or dissolution and suspension). Besides these, any known process may be used to produce the toner particles.

Preferably, the toner particles are obtained by aggregation and coalescence.

If the toner particles are produced by aggregation and coalescence, an example of a specific procedure includes:

preparing a resin particle dispersion as a liquid dispersion in which resin particles to serve as a binder resin are dispersed (preparation of a resin particle dispersion); making the resin particles (and optionally other kind(s) of particles) aggregate in the resin particle dispersion (or a liquid dispersion prepared by mixing with other liquid dispersion(s) of particles) to form aggregates (formation of aggregates); heating the liquid dispersion in which the aggregates are dispersed, or aggregate dispersion, to make the aggregates fuse and coalesce together, thereby forming toner particles (fusion and coalescence).

The following describes the details of each operation.

It should be noted that the method described below gives toner particles that include a coloring agent and a release agent, but the coloring agent and the release agent are optional. Naturally, additives other than a coloring agent and a release agent may also be used.

Preparation of a Resin Particle Dispersion

First, a liquid dispersion in which resin particles to serve as a binder resin are dispersed (resin particle dispersion) is prepared. In addition to this, a liquid dispersion in which particles of a coloring agent are dispersed (coloring agent particle dispersion) and a liquid dispersion in which particles of a release agent are dispersed (release agent particle dispersion), for example, are prepared.

The preparation of the resin particle dispersion is by, for example, dispersing the resin particles in a dispersion medium using a surfactant.

The dispersion medium for the resin particle dispersion may be, for example, an aqueous medium.

Examples of aqueous media include kinds of water, such as distilled water and ion exchange water, and alcohols. One of these may be used alone, or two or more may be used in combination.

The surfactant may be, for example, an anionic surfactant, such as a sulfate surfactant, sulfonate surfactant, phosphate surfactant, or soap surfactant; a cationic surfactant, such as an amine or quaternary ammonium surfactant; or a nonionic surfactant, such as a polyethylene glycol, alkylphenol ethylene oxide, or polyhydric alcohol surfactant, in particular an anionic or cationic surfactant. Nonionic surfactants, if used, may be used in combination with an anionic or cationic surfactant.

One surfactant may be used alone, or two or more may be used in combination.

In preparing the resin particle dispersion, the process of dispersing the resin particles in the dispersion medium may be done by a commonly used dispersion technique, such as a rotary-shear homogenizer or a ball mill, sand mill, Dyno-Mill, or other medium mill. For certain types of resin particles, phase inversion emulsification, for example, may be used to disperse the resin particles in the resin particle dispersion.

Phase inversion emulsification is a technique in which the resin to be dispersed is dissolved in a hydrophobic organic solvent in which the resin is soluble, the resulting organic continuous phase (O phase) is neutralized with a base, and then an aqueous medium (W phase) is added to convert the resin from W/O to O/W (so-called phase inversion), forming a discontinuous phase and thereby dispersing particles of the resin in the aqueous medium.

The volume average diameter of the resin particles to be dispersed in the resin particle dispersion may be, for example, 0.01 μm or more and 1 μm or less, preferably 0.08 μm or more and 0.8 μm or less, more preferably 0.1 μm or more and 0.6 μm or less.

This volume average diameter of the resin particles is the volume average particle diameter D50v determined as follows. The particles are analyzed using a laser diffraction particle size analyzer (e.g., LA-700, produced by HORIBA). The measured particle size distribution is divided into segments by particle size (channels). The cumulative distribution of volume is plotted starting from the smallest diameter. The particle diameter at which the cumulative volume is 50% of that of all particles is the volume average particle diameter D50v. For the other dispersions, too, the volume average diameter of the particles therein is that determined by the same method.

The amount of the resin particles in the resin particle dispersion may be, for example, 5% by mass or more and 50% by mass or less, preferably 10% by mass or more and 40% by mass or less.

The preparation of the coloring agent particle and release agent particle dispersions, for example, is similar to that of the resin particle dispersion. The above discussion on the volume average particle diameter, dispersion medium, method of dispersion, and amount for the particles in the resin particle dispersion therefore also applies to the coloring agent particles dispersed in the coloring agent particle dispersion and the release agent particles dispersed in the release agent particle dispersion.

Formation of Aggregates

Then, the resin particle dispersion is mixed with the coloring agent particle and release agent particle dispersions.

In the mixture of dispersions, the resin particles, the coloring agent particles, and the release agent particles are caused to aggregate together. Through this process of heteroaggregation, aggregates that include resin, coloring agent, and release agent particles are formed to a diameter close to the planned diameter of the toner particles.

A specific example of a procedure is as follows. A flocculant is added to the dispersion mixture, and the pH of the mixture is adjusted to an acidic level (e.g., a pH of 2 or more and 5 or less). At this point, a dispersion stabilizer may optionally be added. The dispersion mixture is then heated to a temperature close to the glass transition temperature of the resin particles (specifically, for example, a temperature higher than or equal to the resin particles' glass transition temperature minus 30° C. but not higher than the resin particles' glass transition temperature minus 10° C.) to make the particles dispersed in the mixture aggregate together, forming aggregates.

In an exemplary configuration of the formation of aggregates, the dispersion mixture may be stirred using a rotary-shear homogenizer, and the flocculant may be added at room temperature (e.g., 25° C.) while the mixture is stirred. Then the pH of the mixture is adjusted to an acidic level (e.g., a pH of 2 or more and 5 or less) and then, optionally with a dispersion stabilizer therein, heated as described above.

The flocculant may be, for example, a surfactant that has the opposite polarity to that used as a dispersant in the dispersion mixture, an inorganic metal salt, or a metal complex having a valency of 2 or more. The use of a metal complex as a flocculant improves charging characteristics by reducing the amount of surfactants used.

An additive that forms a complex or similar linkage with metal ions of the flocculant may optionally be used. This additive may be a chelating agent.

Examples of inorganic metal salts include metal salts such as calcium chloride, calcium nitrate, barium chloride, magnesium chloride, zinc chloride, aluminum chloride, and aluminum sulfate, and polymers of inorganic metal salts, such as polyaluminum chloride, polyaluminum hydroxide, and calcium polysulfide.

The chelating agent may be a water soluble one. Examples of chelating agents include oxycarboxylic acids, such as tartaric acid, citric acid, and gluconic acid, iminodiacetic acid (IDA), nitrilotriacetic acid (NTA), and ethylenediaminetetraacetic acid (EDTA).

The amount of the chelating agent may be, for example, 0.01 parts by mass or more and 5.0 parts by mass or less, preferably 0.1 parts by mass or more and less than 3.0 parts by mass, per 100 parts by mass of resin particles.

Fusion and Coalescence

The aggregates are then caused to fuse and coalesce together and thereby to form toner particles, for example by heating the liquid dispersion in which the aggregates are dispersed, or aggregate dispersion, to at least the resin particles' glass transition temperature (e.g., to 10° C. to 30° C. higher than the resin particles' glass transition temperature).

The fusion and coalescence of the aggregates into toner particles may alternatively be achieved by heating the aggregate dispersion to at least the melting temperature of the release agent. In the process of fusion and coalescence, the resin and release agent fuse together at a temperature that is higher than or equal to the glass transition temperature of the resin particles and higher than or equal to the melting temperature of the release agent. The heated aggregate dispersion is then cooled to give toner.

The adjustment of the aspect ratio of the release agent in the toner may be done by several methods. For example, the toner may be maintained near the freezing point of the release agent for a certain period of time during cooling so that crystal growth will take place, or two or more release agents with different melting temperatures may be used to accelerate crystal growth during cooling.

Through these operations, the toner particles are obtained.

Alternatively, the toner particles may be produced as follows. After the preparation of the liquid dispersion in which aggregates are dispersed (aggregate dispersion), this aggregate dispersion is mixed with another liquid dispersion in which resin particles are dispersed (resin-particle dispersion), and the resin particles and the aggregates are caused to aggregate together in such a manner that the resin particles adhere to the surface of the aggregates. This gives second aggregates. The resulting liquid dispersion in which the second aggregates are dispersed, or second-aggregate dispersion, is heated to make the second aggregates fuse and coalesce and thereby form core/shell toner particles.

After the end of fusion and coalescence, the toner particles, formed in a solution, are subjected to known operations of washing, solid-liquid separation, and drying to give dry toner particles.

The washing may be by replacement with plenty of ion exchange water in view of ease of charging. The solid-liquid separation may be by any method, but techniques such as suction filtration and pressure filtration may be used in view of productivity. The drying, too, may be by any method, but techniques such as freeze drying, flash drying, fluidized drying, and vibrating fluidized drying may be used in view of productivity.

The specific toner is then produced, for example by mixing the resulting dry toner particles with external additive(s). The mixing may be performed using, for example, a V-blender, HENSCHEL mixer, or Ladige mixer. The toner may optionally be sieved, for example through a vibrating sieve or air-jet sieve, to remove coarse particles.

Carrier

Any type of carrier may be used, and examples include known carriers. The carrier may be, for example, a coated carrier, which is formed by covering the surface of a magnetic powder with a coating resin; a magnetic powder dispersed carrier, formed by dispersing and mixing a magnetic powder in a matrix resin; or a resin impregnated carrier, formed by impregnating a porous magnetic powder with a resin.

A magnetic powder dispersed or resin impregnated carrier may be one formed by the constituting particles as a core and a coating resin covering this core.

Examples of magnetic powders include powders of magnetic metals, such as iron, nickel, and cobalt, and magnetic oxides, such as ferrite and magnetite.

For the coating and matrix resins, examples include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins, which include organosiloxane bonds, or their modified forms, fluoropolymers, polyester, polycarbonate, phenolic resins, and epoxy resins.

The coating and matrix resins may contain additives, such as conductive particles.

Examples of conductive particles include particles of gold, silver, copper, or any other metal, carbon black, titanium oxide, zinc oxide, tin oxide, barium sulfate, aluminum borate, and potassium titanate.

The coating method of the surface of the core with a coating resin may be by, for example, using a solution of the coating resin and optionally additives in a solvent (solution for coating layer formation). The solvent may be of any kind and is selected in consideration of, for example, the coating resin used and suitability for application.

Specific examples of methods of resin coating include dipping, which means immersing the core in the solution for coating layer formation, spraying, which means spraying the solution for coating layer formation onto the surface of the core, the fluidized bed method, in which the core is caused to float on flowing air and sprayed with the solution for coating layer formation in that state, and the kneader-coater method, in which mixing of the core for the carrier with the solution for coating layer formation and removal of the solvent are performed in a kneader-coater.

For a two-component developer, the mixing ratio (by mass) between the toner and the carrier may be between 1:100 and 30:100 (toner:carrier), preferably between 3:100 and 20:100.

EXAMPLES

The following describes examples of an exemplary embodiment of the present disclosure, but the exemplary embodiment of the present disclosure is not limited to these examples. In the following description, all "parts" and "%" are by mass unless stated otherwise. The viscosity, highest-endothermic-peak temperature, and absorbances at selected wavelengths of the toners are measured as described above.

The viscosity, highest-endothermic-peak temperature, and absorbances at selected wavelengths of the toners are measured as described above.

Developers A1 to A13 and B1 to B3

Preparation of Liquid Dispersions of Styrene-Acrylic Resin Particles

Production of Resin Particle Dispersion (1)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1 part A solution of 4 parts of an anionic surfactant (DOWFAX, produced by Dow Chemical) in 550 parts of ion exchange water is put into a flask, and a liquid mixture of the above raw materials is added to cause emulsification. While the emulsified liquid is stirred slowly for 10 minutes, a solution of 6 parts of ammonium persulfate in 50 parts of ion exchange water is added. The system is then purged with plenty of nitrogen and heated in an oil bath until the temperature inside reaches 75° C., and polymerization is allowed to proceed for 30 minutes.

Next,

Styrene: 110 parts
n-Butyl acrylate: 50 parts
β-Carboxyethyl acrylate: 5 parts
1,10-Decanediol diacrylate: 2.5 parts
Dodecanethiol: 2 parts a liquid mixture of the above raw materials is added to cause emulsification, the emulsified liquid is added to the flask over 120 minutes, and emulsification polymerization is continued for another 4 hours. This gives a resin particle dispersion as a liquid dispersion of resin particles having a weight average molecular weight of 32,000, a glass transition temperature of 53° C., and a volume average diameter of 240 nm. To this resin particle dispersion, ion exchange water is added to adjust the solids content to 20% by mass. The resulting dispersion is resin particle dispersion (1).

Production of Resin Particle Dispersion (2)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (DOWFAX, produced by Dow Chemical) in 550 parts of ion exchange water is put into a flask, and a liquid mixture of the above raw materials is added to cause emulsification. While the emulsified liquid is stirred slowly for 10 minutes, a solution of 6 parts of ammonium persulfate in 50 parts of ion exchange water is added. The system is then purged with plenty of nitrogen and heated in an oil bath until the temperature inside reaches 75° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 2.5 parts a liquid mixture of the above raw materials is added to cause emulsification, the emulsified liquid is added to the flask over 120 minutes, and emulsification polymerization is continued for another 4 hours. This gives a resin particle dispersion as a liquid dispersion of resin particles having a weight average molecular weight of 30,000, a glass transition temperature of 53° C., and a volume average diameter of 220 nm. To this resin particle dispersion, ion exchange water is added to adjust the solids content to 20% by mass. The resulting dispersion is resin particle dispersion (2).

Production of Resin Particle Dispersion (3)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (DOWFAX, produced by Dow Chemical) in 550 parts of ion exchange water is put into a flask, and a liquid mixture of the above raw materials is added to cause emulsification. While the emulsified liquid is stirred slowly for 10 minutes, a solution of 7 parts of ammonium persulfate in 50 parts of ion exchange water is added. The system is then purged with plenty of nitrogen and heated in an oil bath until the temperature inside reaches 80° C., and polymerization is allowed to proceed for 30 minutes.

Next,

Styrene: 110 parts
n-Butyl acrylate: 50 parts
β-Carboxyethyl acrylate: 5 parts
1,10-Decanediol diacrylate: 2.5 parts
Dodecanethiol: 3.0 parts a liquid mixture of the above raw materials is added to cause emulsification, the emulsified liquid is added to the flask over 120 minutes, and emulsification polymerization is continued for another 4 hours. This gives a resin particle dispersion as a liquid dispersion of resin particles having a weight average molecular weight of 28,000, a glass transition temperature of 53° C., and a volume average diameter of 230 nm. To this resin particle dispersion, ion exchange water is added to adjust the solids content to 20% by mass. The resulting dispersion is resin particle dispersion (3).

Production of Resin Particle Dispersion (4)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 2.0 parts A solution of 4 parts of an anionic surfactant (DOWFAX, produced by Dow Chemical) in 550 parts of ion exchange water is put into a flask, and a liquid mixture of the above raw materials is added to cause emulsification. While the emulsified liquid is stirred slowly for 10 minutes, a solution of 7.5 parts of ammonium persulfate in 50 parts of ion exchange water is added. The system is then purged with plenty of nitrogen and heated in an oil bath until the temperature inside reaches 85° C., and polymerization is allowed to proceed for 30 minutes.

Next,

Styrene: 110 parts
n-Butyl acrylate: 50 parts
β-Carboxyethyl acrylate: 5 parts
1,10-Decanediol diacrylate: 2.5 parts
Dodecanethiol: 3.5 parts a liquid mixture of the above raw materials is added to cause emulsification, the emulsified liquid is added to the flask over 120 minutes, and emulsification polymerization is continued for another 4 hours. This gives a resin particle dispersion as a liquid dispersion of resin particles having a weight average molecular weight of 26,500, a glass transition temperature of 53° C., and a volume average diameter of 210 nm. To this resin particle dispersion, ion exchange water is added to adjust the solids content to 20% by mass. The resulting dispersion is resin particle dispersion (4).

Production of Resin Particle Dispersion (5)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 0.8 parts A solution of 4 parts of an anionic surfactant (DOWFAX, produced by Dow Chemical) in 550 parts of ion exchange water is put into a flask, and a liquid mixture of the above raw materials is added to cause emulsification. While the emulsified liquid is stirred slowly for 10 minutes, a solution of 5.5 parts of ammonium persulfate in 50 parts of ion exchange water is added. The system is then purged with plenty of nitrogen and heated in an oil bath until the temperature inside reaches 85° C., and polymerization is allowed to proceed for 30 minutes.

Next,

Styrene: 110 parts
n-Butyl acrylate: 50 parts
β-Carboxyethyl acrylate: 5 parts
1,10-Decanediol diacrylate: 2.5 parts
Dodecanethiol: 1.7 parts a liquid mixture of the above raw materials is added to cause emulsification, the emulsified liquid is added to the flask over 120 minutes, and emulsification polymerization is continued for another 4 hours. This gives a resin particle dispersion as a liquid dispersion of resin particles having a weight average molecular weight of 36,000, a glass transition temperature of 53° C., and a volume average diameter of 260 nm. To this resin particle dispersion, ion exchange water is added to adjust the solids content to 20% by mass. The resulting dispersion is resin particle dispersion (5).

Preparation of Liquid Dispersion of Magenta Colored Particles

C.I. Pigment Red 122: 50 parts
Ionic surfactant NEOGEN RK (produced by DKS Co., Ltd.): 5 parts
Ion exchange water: 220 parts These ingredients are mixed together, and the resulting mixture is processed using an ULTIMAIZER (produced by Sugino Machine Ltd.) for 10 minutes at 240 MPa to give a liquid dispersion of magenta colored particles (solids concentration: 20%).

Preparation of Release Agent Particle Dispersion (1)

Ester wax (WEP-2, produced by NOF Corp.): 100 parts
Anionic surfactant (NEOGEN RK, produced by DKS Co., Ltd.): 2.5 parts
Ion exchange water: 250 parts These materials are mixed together and heated to 120° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (1) as a liquid dispersion of release agent particles having a volume average diameter of 330 nm (solids content, 29.1%).

Preparation of Release Agent Particle Dispersion (2)

Fischer-Tropsch wax (HNP-9, produced by Nippon Seiro Co., Ltd.): 100 parts

Anionic surfactant (NEOGEN RK, produced by DKS Co., Ltd.): 2.5 parts

Ion exchange water: 250 parts

These materials are mixed together and heated to 120° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (2) as a liquid dispersion of release agent particles having a volume average diameter of 340 nm (solids content, 29.2%).

Preparation of Release Agent Particle Dispersion (3)

Paraffin wax (FNP0090, produced by Nippon Seiro Co., Ltd.): 100 parts

Anionic surfactant (NEOGEN RK, produced by DKS Co., Ltd.): 2.5 parts

Ion exchange water: 250 parts

These materials are mixed together and heated to 120° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (3) as a liquid dispersion of release agent particles having a volume average diameter of 360 nm (solids content, 29.0%).

Preparation of Release Agent Particle Dispersion (4)

Polyethylene wax (POLYWAX 725, produced by Toyo ADL Corp.): 100 parts

Anionic surfactant (NEOGEN RK, produced by DKS Co., Ltd.): 2.5 parts

Ion exchange water: 250 parts

These materials are mixed together and heated to 100° C. After dispersion using a homogenizer (IKA ULTRA-TURRAX T50), the mixture is subjected to further dispersion using a Manton-Gaulin high-pressure homogenizer (produced by MANTON GAULIN MANUFACTURING COMPANY, INC.). This gives release agent particle dispersion (4) as a liquid dispersion of release agent particles having a volume average diameter of 370 nm (solids content, 29.3%).

Process for the Production of Toner A1

Ion exchange water: 400 parts

Resin-particle dispersion (1): 200 parts

Liquid dispersion of magenta-colored particles: 40 parts

Release agent particle dispersion (2): 12 parts

Release agent particle dispersion (3): 24 parts

These ingredients are put into a reactor equipped with a thermometer, a pH meter, and a stirrer and are stirred for 30 minutes at a constant rate of 150 rpm and a constant temperature of 30° C. while the temperature is controlled from the outside using a mantle heater.

While the ingredients are dispersed using a homogenizer (ULTRA-TURRAX T50, IKA Japan K.K.), a PAC aqueous solution, prepared by dissolving 2.1 parts of polyaluminum chloride (PAC, produced by Oji Paper Co., Ltd.; 30% powder) in 100 parts of ion exchange water, is added. Then the temperature is increased to 50° C., and the particle diameter is measured using a Coulter Multisizer II (aperture size, 50 μm; Coulter) to ensure that the volume-average particle diameter is 5.0 μm. Then another 115 parts of resin-particle dispersion (1) is added to attach resin particles (shell structure) to the surface of the aggregates.

Then 20 parts of a 10% by mass aqueous solution of a NTA (nitrilotriacetic acid) metal salt (CHELEST 70, produced by Chelest Corp.) is added, and the pH is adjusted to 9.0 with a 1 N aqueous solution of sodium hydroxide. Then the temperature is increased to 91° C. at an elevation rate of 0.05° C./min and maintained at 91° C. for 3 hours, and the resulting toner slurry is cooled to 85° C. and maintained for 1 hour and then cooled to 25° C. The resulting magenta toner is washed by repeated dispersion in ion exchange water and filtration until the filtrate's electrical conductivity is 20 μS/cm or less. The washed toner is vacuum-dried for 5 hours in an oven at 40° C. to give toner particles.

One hundred parts of the toner particles is mixed with 1.5 parts of hydrophobic silica (RY50, produced by Nippon Aerosil Co., Ltd.) and 1.0 part of hydrophobic titanium oxide (T805, produced by Nippon Aerosil Co., Ltd.) for 30 seconds at 10,000 rpm using a sample mill. The mixture is then sieved through a 45-μm-mesh vibrating sieve. The resulting material is toner A1 (toner A1). The volume-average particle diameter of toner A1 is 5.7 μm.

Production of Developer A1

Eight parts of toner A1 and 92 parts of a carrier are mixed using a V-blender. The resulting mixture is developer A1 (electrostatic-charge-image developer A1).

Production of Developers A2 to A13 and B1 and B2

Magenta toners A2 to A13 and B1 and B2 are each obtained in the same way as toner A1 except that parameter changes are made as in Table 1 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developers A2 to A13 and B1 and B2 are each produced in the same way as developer A1 except that the respective toners are used.

Production of Developer B3

Magenta toner B3 is obtained in the same way as toner A1 except that parameter changes are made as in Table 1 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developer B3 is produced in the same way as developer A1 except that the resulting toner is used.

TABLE 1

| Toner | (Inη (T1) − Inη (T2))/(T1 − T2) | (Inη (T2) − Inη (T3))/(T2 − T3) | (Inη (T0) − Inη (T1))/(T0 − T1) | (Inη (T2) − Inη (T3))/(T2 − T3) − (Inη (T1) − Inη (T2))/(T1 − T2) | (Inη (T0) − Inη (T1))/(T0 − T1) − (Inη (T1) − Inη (T2))/(T1 − T2) | Toner's highest-endothermic-peak temperature (° C.) | a/b | c/d | Resin-particle dispersion |
|---|---|---|---|---|---|---|---|---|---|
| A1 | −0.215 | −0.090 | −0.110 | 0.125 | 0.105 | 85 | 5.0 | 2.9 | (3) |
| A2 | −0.168 | −0.080 | −0.085 | 0.088 | 0.083 | 85 | 5.1 | 2.5 | (2) |

TABLE 1-continued

| | | | | | | | | | |
|---|---|---|---|---|---|---|---|---|---|
| A3 | −0.143 | −0.100 | −0.078 | 0.043 | 0.065 | 85 | 4.9 | 2.6 | (1) |
| A4 | −0.213 | −0.090 | −0.106 | 0.123 | 0.107 | 85 | 5.0 | 2.8 | (3) |
| A5 | −0.214 | −0.100 | −0.110 | 0.114 | 0.104 | 85 | 5.1 | 2.4 | (3) |
| A6 | −0.154 | −0.135 | −0.077 | 0.019 | 0.077 | 70 | 5.1 | 2.6 | (1) |
| A7 | −0.153 | −0.133 | −0.080 | 0.020 | 0.073 | 100 | 4.9 | 2.8 | (1) |
| A8 | −0.155 | −0.141 | −0.083 | 0.014 | 0.072 | 63 | 5.0 | 2.5 | (1) |
| A9 | −0.156 | −0.136 | −0.079 | 0.020 | 0.077 | 102 | 5.1 | 2.9 | (1) |
| A10 | −0.152 | −0.141 | −0.073 | 0.011 | 0.079 | 85 | 1.5 | 1.3 | (1) |
| A11 | −0.153 | −0.142 | −0.071 | 0.011 | 0.082 | 85 | 7.2 | 3.5 | (1) |
| A12 | −0.155 | −0.135 | −0.075 | 0.020 | 0.080 | 85 | 8.5 | 4.5 | (1) |
| A13 | −0.154 | −0.134 | −0.078 | 0.020 | 0.076 | 85 | 0.7 | 0.6 | (1) |
| B1 | −0.129 | −0.090 | −0.068 | 0.039 | 0.061 | 85 | 5.3 | 2.9 | (5) |
| B2 | −0.215 | −0.155 | −0.113 | 0.060 | 0.102 | 85 | 5.3 | 2.9 | (3) |
| B3 | −0.180 | −0.186 | −0.109 | −0.006 | 0.071 | 85 | 5.3 | 2.9 | (4) |

| | First release agent particle dispersion | | Second release agent particle dispersion | | Toner production parameters | | | |
|---|---|---|---|---|---|---|---|---|
| Toner | Type | Parts | Type | Parts | Amount of flocculant (parts) | Coalescence temperature (° C.) | Maintenance temperature (° C.) | Duration of maintenance (hours) |
| A1 | (2) | 12 | (3) | 24 | 2.1 | 91 | 85 | 1 |
| A2 | (2) | 12 | (3) | 24 | 2.1 | 92 | 85 | 1 |
| A3 | (2) | 12 | (3) | 24 | 2.1 | 93 | 85 | 1 |
| A4 | (2) | 12 | (3) | 24 | 1.9 | 92 | 85 | 1 |
| A5 | (2) | 12 | (3) | 24 | 1.7 | 91 | 85 | 1 |
| A6 | (1) | 12 | (2) | 24 | 1.7 | 77 | 70 | 1 |
| A7 | (3) | 12 | (4) | 24 | 1.7 | 108 | 95 | 1 |
| A8 | (1) | 28.8 | (2) | 7.2 | 1.7 | 70 | 65 | 1 |
| A9 | (3) | 7.2 | (4) | 28.8 | 1.7 | 108 | 95 | 1 |
| A10 | (2) | 12 | (3) | 24 | 1.7 | 91 | 85 | 0.5 |
| A11 | (2) | 12 | (3) | 24 | 1.7 | 92 | 85 | 2 |
| A12 | (2) | 12 | (3) | 24 | 1.7 | 93 | 85 | 3 |
| A13 | (2) | 12 | (3) | 24 | 1.7 | 92 | 85 | 0.25 |
| B1 | (2) | 12 | (3) | 24 | 2.1 | 91 | 85 | 1 |
| B2 | (2) | 12 | (3) | 24 | 1.5 | 93 | 85 | 1 |
| B3 | (2) | 12 | (3) | 24 | 2.1 | 93 | 85 | 1 |

Production of Electrophotographic Photoreceptor A1

Formation of an Undercoat Layer

One hundred parts by mass of zinc oxide (average particle diameter, 70 nm; produced by Tayca Corporation; specific surface area, 15 $m^2/g$) is mixed with 500 parts by mass of toluene by stirring, 1.3 parts by mass of a silane coupling agent (KBM503, produced by Shin-Etsu Chemical) is added, and the resulting mixture is stirred for 2 hours. The toluene is removed by distillation under reduced pressure, and the residue is baked at 120° C. for 3 hours to give a zinc oxide surface-treated with the silane coupling agent. Then 110 parts by mass of the surface-treated zinc oxide is mixed with 500 parts by mass of tetrahydrofuran by stirring, a solution of 0.6 parts by mass of alizarin in 50 parts by mass of tetrahydrofuran is added, and the resulting mixture is stirred at 50° C. for 5 hours. The alizarin-attached zinc oxide is isolated by filtration under reduced pressure and then dried at 60° C. under reduced pressure to give alizarin-attached zinc oxide.

Sixty parts by mass of the alizarin-attached zinc oxide, 13.5 parts by mass of a curing agent (blocked isocyanate, SUMIDUR 3175, produced by Sumitomo Bayern Urethane), and 15 parts by mass of a butyral resin (S-LEC BM-1, produced by Sekisui Chemical) are mixed into 85 parts by mass of methyl ethyl ketone, 38 parts by mass of the resulting liquid is mixed with 25 parts by mass of methyl ethyl ketone, and the resulting mixture is subjected to 2 hours of dispersion with 1-mm glass beads in a sand mill to give a liquid dispersion. To the liquid dispersion, 0.005 parts by mass of dioctyltin dilaurate as a catalyst and 40 parts by mass of particles of a silicone resin (TOSPEARL 145, produced by Momentive Performance Materials) are added. The resulting liquid is a liquid for undercoat layer formation. The liquid for undercoat layer formation is applied to an aluminum substrate by dip coating, and the resulting coating is dried and cured at 170° C. for 40 minutes to give a 20-μm thick undercoat layer.

Formation of a Charge-Generating Layer

A mixture of 15 parts by mass of a charge-generating material (CGM-1), 10 parts by mass of a vinyl chloride-vinyl acetate copolymer resin (VMCH, produced by Nippon Unicar) as a binder resin, and 200 parts by mass of n-butyl acetate is subjected to 4 hours of dispersion with 1-mm glass beads in a sand mill. The charge-generating material is a hydroxygallium phthalocyanine whose x-ray diffraction spectrum measured using characteristic x-rays of Cuka has diffraction peaks at Bragg angles (2θ±0.2°) of at least 7.3°, 16.0°, 24.9°, and 28.0°. The resulting liquid dispersion is stirred with 175 parts by mass of n-butyl acetate and 180 parts by mass of methyl ethyl ketone. The resulting liquid is a liquid for charge-generating layer formation. The liquid for charge-generating layer formation is applied to the undercoat layer by dip coating, and the resulting coating is dried at room temperature (25° C.) to give a 0.2-μm thick charge-generating layer.

Formation of a Charge-Transport Layer

To 100 parts by mass of untreated (hydrophilic) silica particles "trade name, OX50 (manufacturer: Aerosil); volume-average diameter, 40 nm," 30 parts of a trimethylsilane compound (1,1,1,3,3,3-hexamethyldisilazane (produced by Tokyo Chemical Industry)) as an agent for hydrophobic treatment is added. After 24 hours of reaction, the product is collected by filtration. The resulting hydrophobic silica particles are silica particles (1). The percentage condensation of silica particles (1) is 93%.

Then 250 parts by mass of tetrahydrofuran is added to 50 parts by mass of silica particles (1), and the resulting mixture is mixed with 25 parts by mass of 4-(2,2-diphenylethyl)-4', 4"-dimethyl-triphenylamine as a charge-transport material and 25 parts by mass of a bisphenol-Z polycarbonate resin (viscosity-average molecular weight: 30000) as a binder resin by stirring for 12 hours with the liquid's temperature kept at 20° C. The resulting liquid is a liquid for charge-transport layer formation.

The liquid for charge-transport layer formation is applied to the charge-generating layer. The resulting coating is dried at 135° C. for 40 minutes to give a 30-μm thick charge-transport layer, completing an electrophotographic photoreceptor.

Formation of a Surface-Protecting Layer

Then 30 parts by mass of compound (A-4) below, which is a charge-transport material, 0.2 parts by mass of colloidal silica (trade name, PL-1; produced by Fuso Chemical), 30 parts by mass of toluene, 0.1 parts by mass of 3,5-di-t-butyl-4-hydroxytoluene (BHT), 0.1 parts by mass of azoisobutyronitrile (10-hour half-life temperature: 65° C.), and V-30 (produced by FUJIFILM Wako Pure Chemical Corporation; 10-hour half-life temperature, 104° C.) are combined. The resulting liquid is a liquid for surface-protecting layer formation. This liquid is applied to the charge-transport layer by spray coating, and the resulting coating is air-dried at room temperature (25° C.) for 30 minutes, then heated from room temperature to 150° C. over 30 minutes at an oxygen concentration of 110 ppm, and then further heated at 150° C. for 30 minutes to cure, giving a 10-μm thick surface-protecting layer. The universal hardness of the surface-protecting layer measured as described above is 200 N/mm$^2$. The resulting electrophotographic photoreceptor is electrophotographic photoreceptor A1.

Production of Cleaning Blade A1

A polyurethane plate having a hardness of 75 degrees and measuring 347 mm×10 mm×2 mm (thickness) is used as cleaning blade A1. The ratio of the hardness of the cleaning blade ($H_{BLD}$) to that of the surface-protecting layer ($H_{OCL}$), which forms the surface of the electrophotographic photoreceptor, is 0.38 ($H_{BLD}/H_{OCL}$).

Examples 1 to 13 and Comparative Examples 1 to 3

A modified COLOR 10000 PRESS (produced by Fuji Xerox Co., Ltd.) is prepared as an image forming apparatus. The developer specified in Table 2 is loaded, and electrophotographic photoreceptor A1 and cleaning blade A1 are each attached as an electrophotographic photoreceptor and a cleaning blade. The angle θ between the cleaning blade and the electrophotographic photoreceptor (angle of contact) is 11°, and the pressure N with which the cleaning blade is pressed against the electrophotographic photoreceptor is set to 2.5 gf/mm$^2$.

Evaluation

Test 1, for the Streak-Shaped Image Defect Caused by Crushed Residual toner (filming)

The image forming apparatuses of each Example or Comparative Example are tested for the streak-shaped image defect that occurs under high-temperature and high-humidity conditions (28° C. and 85%) as a result of crushed residual toner (filming). The details of the test are as follows.

An image with an area coverage of 20% is printed until a pv of 5000 (pv=print volume, the number of sheets on which the image is formed), and then a full-size 50% halftone image is printed on one sheet. The electrophotographic photoreceptor is microscopically observed for any sign of filming, and the halftone image is inspected for white streaks. The criteria for grading are as follows. Grades A to C are passing grades.

A: No filming on the electrophotographic photoreceptor, and no white streaks in terms of image quality.

(A-4)

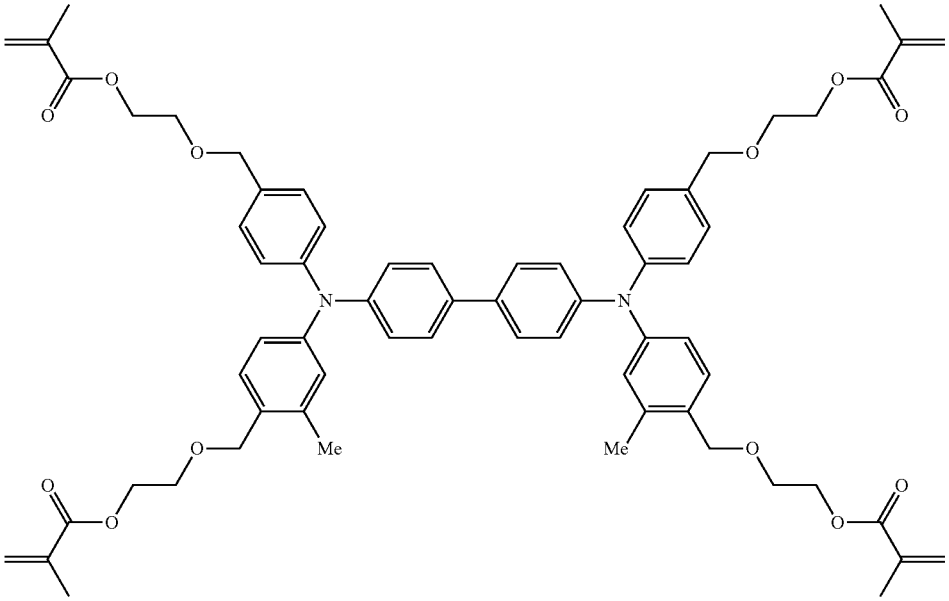

B: Very minor filming on the electrophotographic photoreceptor, and no white streaks in terms of image quality.

C: Streak-shaped filming on the electrophotographic photoreceptor, and no white streaks in terms of image quality.

D: Streak-shaped filming on the electrophotographic photoreceptor, and white streaks in terms of image quality. Test 2, for the Streak-Shaped Image Defect Caused by Passed Residual toner The image forming apparatuses of each Example or Comparative Example are tested for the streak-shaped image defect that occurs under low-temperature and low-humidity conditions (10° C. and 15%) as a result of passed residual toner. The details of the test are as follows.

An image with an area coverage of 1% is printed until a pv of 5000 (pv=print volume, the number of sheets on which the image is formed), and then a full-size 50% halftone image is printed on one sheet. The electrophotographic photoreceptor is microscopically observed for any sign of filming, and the halftone image is inspected for white streaks. The criteria for grading are as follows.

A: No filming on the electrophotographic photoreceptor, and no white streaks in terms of image quality.

B: Very minor filming on the electrophotographic photoreceptor, and no white streaks in terms of image quality.

C: Streak-shaped filming on the electrophotographic photoreceptor, and no white streaks in terms of image quality.

TABLE 2

| | | Developer | Evaluation: Streak-shaped image defect 1 | Evaluation: Streak-shaped image defect 2 |
|---|---|---|---|---|
| Examples | 1 | A1 | C | A |
| | 2 | A2 | B | B |
| | 3 | A3 | A | B |
| | 4 | A4 | C | A |
| | 5 | A5 | C | A |
| | 6 | A6 | A | B |
| | 7 | A7 | B | B |
| | 8 | A8 | B | B |
| | 9 | A9 | A | B |
| | 10 | A10 | A | C |
| | 11 | A11 | A | C |
| | 12 | A12 | A | B |
| | 13 | A13 | A | B |
| Comparative Examples | 1 | B1 | D | A |
| | 2 | B2 | D | A |
| | 3 | B3 | D | A |

As can be seen from the table, the image forming apparatuses of Examples reduce both the streak-shaped image defect caused by filming and that caused by passed residual toner in comparison with those of Comparative Examples.

Developers A101 to A113 and B101 to B103

Preparation of Liquid Dispersions of Amorphous Polyester Resin Particles

Production of Resin-Particle Dispersion (101)

To a dried three-neck flask are added 60 parts of dimethyl terephthalate, 74 parts of dimethyl fumarate, 30 parts of dodecenylsuccinic anhydride, 22 parts of trimellitic acid, 138 parts of propylene glycol, and 0.3 parts of dibutyltin oxide. In a nitrogen atmosphere, the reaction is allowed to proceed for 3 hours at 185° C. while the water resulting from the reaction is removed out of the system. Then the temperature is increased to 240° C. while the pressure is reduced gradually. After another 4 hours of reaction, the system is cooled. The product is amorphous polyester resin (101) and has a weight-average molecular weight of 39,000.

After the removal of any precipitate, 200 parts of amorphous polyester resin (101) is added to a separable flask together with 100 parts of methyl ethyl ketone, 35 parts of isopropyl alcohol, and 7.0 parts of a 10% by mass aqueous solution of ammonia. The materials are mixed thoroughly to dissolve the resin, and then ion exchange water is added dropwise using a delivery pump at a rate of 8 g/min while the solution is heated and stirred at 40° C. After the solution becomes uniformly turbid, the delivery of ion exchange water is continued at an increased rate of 15 g/min to induce phase inversion and terminated after 580 parts of water has been added. Then the solvents are removed under reduced pressure. The resulting liquid is liquid dispersion (101) of amorphous polyester resin particles (resin-particle dispersion (101)). The volume-average diameter and solids concentration of the resulting polyester resin particles are 170 nm and 35%, respectively.

Preparation of Resin-Particle Dispersions (102) to (105)

Resin-particle dispersions (102) to (105) are obtained in the same way as resin-particle dispersion (101) except that the polymerization is performed under the conditions specified in Table 3.

TABLE 3

| | Resin's durations of polymerization | Polyester resin's weight-average molecular weight |
|---|---|---|
| Dispersion (101) of amorphous polyester resin particles | 3 hours at 185° C., 4 hours at 240° C. | 39,000 |
| Dispersion (102) of amorphous polyester resin particles | 2.5 hours at 185° C., 3.5 hours at 240° C. | 37,000 |
| Dispersion (103) of amorphous polyester resin particles | 2 hours at 185° C., 3 hours at 240° C. | 35,000 |
| Dispersion (104) of amorphous polyester resin particles | 1.5 hours at 185° C., 2.5 hours at 240° C. | 33,000 |
| Dispersion (105) of amorphous polyester resin particles | 4 hours at 185° C., 5 hours at 240° C. | 43,000 |

Process for the Production of Toner A101

Ion exchange water: 400 parts

Liquid dispersion (101) of amorphous polyester resin particles: 200 parts

Liquid dispersion of magenta-colored particles: 40 parts

Release agent particle dispersion (2): 12 parts

Release agent particle dispersion (3): 24 parts

These ingredients are put into a reactor equipped with a thermometer, a pH meter, and a stirrer and are stirred for 30 minutes at a constant rate of 150 rpm and a constant temperature of 30° C. while the temperature is controlled from the outside using a mantle heater.

While the ingredients are dispersed using a homogenizer (ULTRA-TURRAX T50, IKA Japan K.K.), a PAC aqueous solution, prepared by dissolving 2.1 parts of polyaluminum chloride (PAC, Oji Paper Co., Ltd.; 30% powder) in 100 parts of ion exchange water, is added. Then the temperature is increased to 50° C., and the particle diameter is measured using a Coulter Multisizer II (aperture size, 50 μm; Coulter) to ensure that the volume-average particle diameter is 4.9 μm. Then another 115 parts of liquid dispersion (101) of amorphous polyester resin particles is added to attach resin particles (shell structure) to the surface of the aggregates.

Then 20 parts of a 10% by mass aqueous solution of a NTA (nitrilotriacetic acid) metal salt (CHELEST 70, Chelest Corp.) is added, and the pH is adjusted to 9.0 with a 1 N aqueous solution of sodium hydroxide. Then the temperature is increased to 91° C. at an elevation rate of 0.05° C./min and maintained at 91° C. for 3 hours, and the resulting toner slurry is cooled to 85° C. and maintained for 1 hour and then cooled to 25° C. The resulting magenta toner is washed by repeated dispersion in ion exchange water and filtration until the filtrate's electrical conductivity is 20 μS/cm or less. The washed toner is vacuum-dried for 5 hours in an oven at 40° C. to give toner particles.

One hundred parts of the toner particles is mixed with 1.5 parts of hydrophobic silica (RY50, Nippon Aerosil Co., Ltd.) and 1.0 part of hydrophobic titanium oxide (T805, Nippon Aerosil Co., Ltd.) for 30 seconds at 10,000 rpm using a sample mill. The mixture is then sieved through a 45-μm-mesh vibrating sieve. The resulting material is toner A101 (toner A101 for electrostatic charge image development). The volume-average particle diameter of toner A101 is 5.8 μm.

Production of Developer A101

Eight parts of toner A101 and 92 parts of a carrier are mixed using a V-blender. The resulting mixture is developer A101 (electrostatic-charge-image developer A101).

Production of Developers A102 to A113 and B101 and B102

Magenta toners A102 to A113 and B101 and B102 are each obtained in the same way as toner A101 except that parameter changes are made as in Table 4 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developers A102 to A113 and B101 and B102 are each produced in the same way as developer A101 except that the respective toners are used.

Production of Developer B103

Magenta toner B103 is obtained in the same way as toner A101 except that parameter changes are made as in Table 4 regarding the resin-particle dispersion, the release agent particle dispersions, the amount of flocculant, the temperature at which coalescence is performed, the temperature at which the toner slurry is maintained, and the duration for which the toner slurry is maintained at that temperature.

Then electrostatic-charge-image developer B103 is produced in the same way as developer A101 except that the resulting toner is used.

TABLE 4

| Toner | (Inη (T1) − Inη (T2))/(T1 − T2) | (Inη (T2) − Inη (T3))/(T2 − T3) | (Inη (T0) − Inη (T1))/(T0 − T1) | (Inη (T2) − Inη (T3))/(T2 − T3) − (Inη (T1) − Inη (T2))/(T1 − T2) | (Inη (T0) − Inη (T1))/(T0 − T1) − (Inη (T1) − Inη (T2))/(T1 − T2) | Toner's highest-endothermic-peak temperature (° C.) | a/b | c/d | 1,500 $cm^{-1}$/720 $cm^{-1}$ | 820 $cm^{-1}$/720 $cm^{-1}$ |
|---|---|---|---|---|---|---|---|---|---|---|
| A101 | −0.220 | −0.110 | −0.100 | 0.110 | 0.120 | 85 | 5.2 | 2.7 | 0.30 | 0.16 |
| A102 | −0.163 | −0.070 | −0.080 | 0.093 | 0.083 | 85 | 4.9 | 2.3 | 0.31 | 0.15 |
| A103 | −0.141 | −0.100 | −0.065 | 0.041 | 0.076 | 85 | 4.8 | 2.7 | 0.29 | 0.17 |
| A104 | −0.222 | −0.080 | −0.111 | 0.142 | 0.111 | 85 | 5.2 | 2.7 | 0.33 | 0.16 |
| A105 | −0.211 | −0.110 | −0.101 | 0.101 | 0.110 | 85 | 5.0 | 2.5 | 0.34 | 0.17 |
| A106 | −0.156 | −0.131 | −0.075 | 0.025 | 0.081 | 70 | 4.9 | 2.4 | 0.30 | 0.16 |
| A107 | −0.154 | −0.135 | −0.072 | 0.019 | 0.082 | 100 | 4.7 | 2.9 | 0.29 | 0.15 |
| A108 | −0.155 | −0.139 | −0.079 | 0.016 | 0.076 | 85 | 1.6 | 1.4 | 0.33 | 0.17 |
| A109 | −0.154 | −0.141 | −0.077 | 0.013 | 0.077 | 85 | 7.1 | 3.3 | 0.29 | 0.18 |
| A110 | −0.151 | −0.136 | −0.072 | 0.015 | 0.079 | 63 | 5.2 | 2.9 | 0.27 | 0.16 |
| A111 | −0.153 | −0.140 | −0.081 | 0.013 | 0.072 | 102 | 5.1 | 2.5 | 0.34 | 0.17 |
| A112 | −0.152 | −0.133 | −0.080 | 0.019 | 0.072 | 85 | 8.6 | 4.6 | 0.33 | 0.16 |
| A113 | −0.151 | −0.133 | −0.071 | 0.018 | 0.080 | 85 | 0.8 | 0.5 | 0.31 | 0.15 |
| B101 | −0.127 | −0.110 | −0.055 | 0.017 | 0.072 | 85 | 5.0 | 2.7 | 0.34 | 0.16 |
| B102 | −0.221 | −0.160 | −0.132 | 0.061 | 0.089 | 85 | 5.1 | 2.8 | 0.28 | 0.18 |
| B103 | −0.203 | −0.224 | −0.119 | −0.021 | 0.084 | 85 | 5.3 | 3.0 | 0.36 | 0.17 |

| | | First release agent particle dispersion | | Second release agent particle dispersion | | Toner production parameters | | | |
|---|---|---|---|---|---|---|---|---|---|
| Toner | Resin-particle dispersion | Type | Parts | Type | Parts | Amount of flocculant (parts) | Coalescence temperature (° C.) | Maintenance temperature (° C.) | Duration of maintenance (hours) |
| A101 | (103) | (2) | 12 | (3) | 24 | 2.1 | 91 | 85 | 1 |
| A102 | (102) | (2) | 12 | (3) | 24 | 2.1 | 92 | 85 | 1 |
| A103 | (101) | (2) | 12 | (3) | 24 | 2.1 | 93 | 85 | 1 |
| A104 | (103) | (2) | 12 | (3) | 24 | 1.9 | 92 | 85 | 1 |
| A105 | (103) | (2) | 12 | (3) | 24 | 1.7 | 91 | 85 | 1 |
| A106 | (101) | (1) | 12 | (2) | 24 | 1.7 | 77 | 70 | 1 |
| A107 | (101) | (3) | 12 | (4) | 24 | 1.7 | 108 | 95 | 1 |
| A108 | (101) | (2) | 12 | (3) | 24 | 1.7 | 91 | 85 | 0.5 |
| A109 | (101) | (2) | 12 | (3) | 24 | 1.7 | 92 | 85 | 2 |
| A110 | (103) | (1) | 28.8 | (2) | 7.2 | 1.7 | 70 | 65 | 1 |
| A111 | (103) | (3) | 7.2 | (4) | 28.8 | 1.7 | 108 | 95 | 1 |
| A112 | (103) | (2) | 12 | (3) | 24 | 1.7 | 93 | 85 | 3 |
| A113 | (103) | (2) | 12 | (3) | 24 | 1.7 | 92 | 85 | 0.25 |
| B101 | (105) | (2) | 12 | (3) | 24 | 2.1 | 91 | 85 | 1 |
| B102 | (103) | (2) | 12 | (3) | 24 | 1.5 | 93 | 85 | 1 |
| B103 | (104) | (2) | 12 | (3) | 24 | 1.5 | 93 | 85 | 1 |

Examples 101 to 113 and Comparative Examples 101 to 103

A modified COLOR 10000 PRESS (Produced by Fuji Xerox Co., Ltd.) is prepared as an image forming apparatus. The developer specified in Table 5 is loaded, and electrophotographic photoreceptor A1 and cleaning blade A1 are each attached as an electrophotographic photoreceptor and a cleaning blade. The angle θ between the cleaning blade and the electrophotographic photoreceptor (angle of contact) is 11°, and the pressure N with which the cleaning blade is pressed against the electrophotographic photoreceptor is set to 2.5 gf/mm$^2$.

Evaluation

Test 1, for the streak-shaped image defect caused by crushed residual toner (filming), and test 2, for the streak-shaped image defect by passed residual toner, are performed in the same way as above.

TABLE 5

| | | Developer | Evaluation | |
|---|---|---|---|---|
| | | | Streak-shaped image defect 1 | Streak-shaped image defect 2 |
| Examples | 101 | A101 | C | A |
| | 102 | A102 | B | B |
| | 103 | A103 | A | A |
| | 104 | A104 | C | A |
| | 105 | A105 | C | A |
| | 106 | A106 | A | B |
| | 107 | A107 | A | C |
| | 108 | A108 | A | B |
| | 109 | A109 | A | B |
| | 110 | A110 | A | C |
| | 111 | A111 | B | B |
| | 112 | A112 | B | B |
| | 113 | A113 | A | C |
| Comparative Examples | 101 | B101 | D | A |
| | 102 | B102 | D | A |
| | 103 | B103 | D | A |

In the above tables, "a/b" is "a/b where a and b are the numbers of the release agents with an aspect ratio of 5 or more and smaller than 5, respectively, in the toner," "c/d" is "c/d where c and d are the areas of the release agents with an aspect ratio of 5 or more and smaller than 5, respectively, in the toner," "1,500 cm$^{-1}$/720 cm$^{-1}$" is the ratio of the absorbance at a wavelength of 1,500 cm$^{-1}$ to that at 720 cm$^{-1}$ in an infrared absorption spectrum of the toner particles of the toner, and "820 cm$^{-1}$/720 cm$^{-1}$" is the ratio of the absorbance at a wavelength of 820 cm$^{-1}$ to that at 720 cm$^{-1}$ in an infrared absorption spectrum of the toner particles of the toner.

As can be seen from the table, the image forming apparatuses of Examples reduce both the streak-shaped image defect caused by filming and that caused by passed residual toner in comparison with those of Comparative Examples.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier that includes a conductive substrate, a photosensitive layer, and a surface-protecting layer;

a charging section configured to charge a surface of the image carrier;

a latent image forming section configured to form an electrostatic latent image on the image carrier;

a developing section configured to form a toner image by developing the electrostatic latent image using toner;

a transfer section configured to transfer the toner image to a recording medium; and a cleaning section configured to remove toner residue on the surface of the image carrier using a cleaning blade, wherein the toner satisfies the following relations:

$$(\ln\eta(T1)-\ln\eta(T2))/(T1-T2)\leq-0.14;$$

$$(\ln\eta(T2)-\ln\eta(T3))/(T2-T3)\geq-0.15;\text{ and}$$

$$(\ln\eta(T1)-\ln\eta(T2))/(T1-T2)<(\ln\eta(T2)-\ln\eta(T3))/(T2-T3),$$

wherein has units of Pa·s, wherein T1=60° C., T2=90° C., and T3=130° C., and wherein η(T1) represents a viscosity of the toner at 60° C., η(T2) represents a viscosity of the toner at 90° C., and η(T3) represents a viscosity of the toner at 130° C.

2. The image forming apparatus according to claim 1, wherein the toner has a (lnη(T0)−lnη(T1))/(T0−T1), wherein η(T0) is a viscosity η of the toner at T0=40° C., of −0.12 or more, and the (lnη(T0)−lnη(T1))/(T0−T1) is greater than the (lnη(T1)−lnη(T2))/(T1−T2).

3. The image forming apparatus according to claim 1, wherein the toner satisfies the following relation:

$$(\ln\eta(T1)-\ln\eta(T2))/(T1-T2)\leq-0.16.$$

4. The image forming apparatus according to claim 1, wherein the toner satisfies the following relation:

$$(\ln\eta(T2)-\ln\eta(T3))/(T2-T3)\geq-0.13.$$

5. The image forming apparatus according to claim 1, wherein the toner has a highest-endothermic-peak temperature between 70° C. and 100° C.

6. The image forming apparatus according to claim 1, wherein the toner has a highest-endothermic-peak temperature between 75° C. and 95° C.

7. The image forming apparatus according to claim 1, wherein the toner contains a styrene-acrylic resin as a binder resin.

8. The image forming apparatus according to claim 1, wherein the toner contains an amorphous polyester resin as a binder resin.

9. The image forming apparatus according to claim 1, wherein a ratio of hardness of the cleaning blade ($H_{BLD}$) and hardness of the surface-protecting layer ($H_{OCL}$) ($H_{BLD}/H_{OCL}$) is 0.8 or less.

10. The image forming apparatus according to claim 1, wherein the surface-protecting layer is a cured form of a composition that contains a charge transport material, which is a material that has a reactive group and a charge-transporting structure in a same molecule.

11. The image forming apparatus according to claim 10, wherein the charge transport material is a compound derived from a triarylamine compound.

12. The image forming apparatus according to claim 1, wherein the surface-protecting layer is a cured form of a composition that contains a compound that has at least one of an acryloyl group and a methacryloyl group.

13. The image forming apparatus according to claim 1, wherein the cleaning blade contains a polyurethane.

14. A process cartridge that is attachable to and detachable from an image forming apparatus, the process cartridge comprising:

a developing section configured to contain toner for electrostatic charge image development and to develop an electrostatic charge image formed on a surface of an electrophotographic photoreceptor into a toner image for electrostatic charge image development; and a cleaning section that has a cleaning blade configured to clean the surface of the electrophotographic photoreceptor by contacting the surface of the electrophotographic photoreceptor, wherein the toner satisfies the following relations:

$$(\ln\eta(T1)-\ln\eta(T2))/(T1-T2)\leq-0.14;$$

$$(\ln\eta(T2)-\ln\eta(T3))/(T2-T3)\geq-0.15;\text{ and}$$

$$(\ln\eta(T1)-\ln\eta(T2))/(T1-T2)<(\ln\eta(T2)-\ln\eta(T3))/(T2-T3),$$

wherein $\eta$ has units of Pa·s, wherein T1=60° C., T2=90° C., and T3=130° C., and wherein $\eta$(T1) represents a viscosity of the toner at 60° C., $\eta$(T2) represents a viscosity of the toner at 90° C., and $\eta$(T3) represents a viscosity of the toner at 130° C.

* * * * *